US011317479B2

(12) United States Patent
Park et al.

(10) Patent No.: US 11,317,479 B2
(45) Date of Patent: Apr. 26, 2022

(54) COOKING APPARATUS AND CONTROL METHOD THEREOF

(71) Applicant: SAMSUNG ELECTRONICS CO., LTD., Suwon-si (KR)

(72) Inventors: Nam Ju Park, Suwon-si (KR); Chang Sun Yun, Suwon-si (KR); Ji Woong Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 15/962,257

(22) Filed: Apr. 25, 2018

(65) Prior Publication Data

US 2018/0317284 A1 Nov. 1, 2018

(30) Foreign Application Priority Data

Apr. 28, 2017 (KR) ..... 10-2017-0055704

(51) Int. Cl.
*H05B 6/06* (2006.01)
*H05B 6/12* (2006.01)

(52) U.S. Cl.
CPC ..... *H05B 6/062* (2013.01); *H05B 6/065* (2013.01); *H05B 6/1236* (2013.01); *H05B 6/1272* (2013.01)

(58) Field of Classification Search
CPC .... H05B 2213/03; H05B 6/062; H05B 6/065; H05B 6/1236; H05B 6/1272
USPC ..... 219/620, 624, 625, 632, 660–665, 668; 363/57
See application file for complete search history.

(56) References Cited

U.S. PATENT DOCUMENTS

2009/0139986 A1 6/2009 Lee et al.
2010/0282740 A1* 11/2010 Artigas Maestre .... H05B 6/065 219/662
2011/0240632 A1* 10/2011 Anton Falcon ..... H05B 6/04 219/601

(Continued)

FOREIGN PATENT DOCUMENTS

EP 2112867 10/2009
JP 2012-84539 4/2012

(Continued)

OTHER PUBLICATIONS

International Search Report dated Aug. 29, 2018 in International Patent Application No. PCT/KR2018/004779.

(Continued)

*Primary Examiner* — Dana Ross
*Assistant Examiner* — Joe E Mills, Jr.
(74) *Attorney, Agent, or Firm* — Staas & Halsey, LLP

(57) ABSTRACT

Disclosed herein is a cooking apparatus. The cooking apparatus includes a cooking plate, a plurality of induction heating coils installed under the cooking plate, a plurality of drivers configured to supply driving power to the plurality of induction heating coils, and a controller configured to control the plurality of drivers to drive a plurality of groups to which the plurality of induction heating coils belong, respectively. Power output by a first driver, among the plurality of drivers, which drives a first group among the plurality of groups may be increased and power output by a second driver, among the plurality of drivers, which drives a second group among the plurality of groups may be decreased.

20 Claims, 22 Drawing Sheets

(56) References Cited

U.S. PATENT DOCUMENTS

| | | | | |
|---|---|---|---|---|
| 2012/0312803 | A1 | 12/2012 | Jeanneteau et al. | |
| 2013/0334213 | A1* | 12/2013 | Isoda | H05B 6/08 219/662 |
| 2017/0079093 | A1 | 3/2017 | Fattorini et al. | |
| 2018/0270914 | A1* | 9/2018 | Calesella | H05B 6/065 |

FOREIGN PATENT DOCUMENTS

| | | |
|---|---|---|
| JP | 5293804 | 9/2013 |
| JP | 2013-206542 | 10/2013 |
| WO | 2010/084096 | 7/2010 |
| WO | 2014/064931 | 5/2014 |

OTHER PUBLICATIONS

Extended European Search Report dated Feb. 19, 2020 in European Patent Application No. 18792333.9.
Korean Office Action dated Feb. 17, 2021 in Korean Patent Application No. 10-2017-0055704.
European Communication dated Mar. 16, 2021 in European Patent Application No. 18792333.9.
Korean Notice of Allowance for Korean Patent Application No. 10-2017-0055704 dated Aug. 25, 2021.

* cited by examiner

COOKING APPARATUS AND CONTROL METHOD THEREOF

CROSS-REFERENCE TO RELATED APPLICATION

This application is based on and claims priority under 35 U.S.C. § 119 to Korean Patent Application No. 10-2017-0055704 filed on Apr. 28, 2017, in the Korean Intellectual Property Office, the disclosure of which is incorporated herein by reference in its entirety.

BACKGROUND

1. Field of the Invention

The present disclosure relates to a cooking apparatus, and more particularly, to a cooking apparatus having a plurality of induction coils.

2. Discussion of Related Art

An induction heating cooker is a cooking apparatus that heats the cookware based on the induction heating principle. The induction heating cooker includes a cooking plate to have the cookware put thereon and an induction heating coil that produces a magnetic field when a current is applied thereto.

When a current is applied to the induction heating coil and a magnetic field is produced, a secondary current is induced in the cookware and Joule heat is produced by the electrical resistance of the cookware itself. The cookware and the food contained in the cookware are heated by the Joule heat.

The induction heating cooker has some advantages in that it enables quick heating, produces no harmful gas, and has little risk of catching fire as compared with a gas range or a kerosene furnace that burns fossil fuels like gas or oil to heat the cookware by the combustion heat.

A type of induction heating cooker, which automatically heats the cookware when the cookware is put at any place on the induction heating cooker, has recently been developed. The induction heating cooker includes many induction heating coils, but a smaller number of driving circuits than the induction heating coils drive the induction heating coils.

SUMMARY

The present disclosure provides an induction heating cooking apparatus including a plurality of induction heating coils.

The present disclosure also provides an induction heating cooking apparatus including a plurality of driving circuits to drive a plurality of induction heating coils.

The present disclosure also provides an induction heating cooking apparatus, which divides a plurality of induction heating coils into a plurality of groups and having each of a plurality of driving circuits drive one of the groups.

In accordance with one aspect of the present disclosure, a cooking apparatus includes a cooking plate, a plurality of induction heating coils installed under the cooking plate, a plurality of drivers configured to supply driving power to the plurality of induction heating coils, and a controller configured to control a plurality of drivers to drive a plurality of groups to which the plurality of induction heating coils belong, respectively. Power output by a first driver among the plurality of drivers, which drives a first group among the plurality of groups may be increased and power output by a second driver among the plurality of drivers, which drives a second group among the plurality of groups may be decreased.

The cooking apparatus may include a user interface configured to receive information about output of the cooking apparatus from a user. The controller may identify a total power output by all the plurality of drivers based on the information about output of the cooking apparatus.

The controller may assign the plurality of groups to the plurality of drivers and identify power output by each of the plurality of drivers based on a number of the plurality of induction heating coils belonging to each of the plurality of groups.

The power output by each of the plurality of drivers may be not proportional to the number of the plurality of induction heating coils belonging to the each of the plurality of groups.

The controller may identify offset power to regulate power output by the first driver and the second driver.

The controller may identify the offset power based on a total power output by all the plurality of drivers.

The controller may identify the offset power based on a difference between the power output by the first driver and the power output by the second driver.

The power output by the first driver may be increased by the offset power and the power output by the second driver may be decreased by the offset power.

The controller may divide control of the plurality of induction heating coils into the plurality of groups, respectively, and induction heating coils, among the plurality of induction heating coils, are divided into the first group and the second group based on positions of the induction heating coils which overlap with a position of a cookware placed on the cooking plate.

The first group may include an induction heating coil, an entirety of which overlaps with the position of the cookware and the second group may include an induction heating coil, at least portion of which is outside the position of the cookware.

In accordance with one aspect of the present disclosure, a method of controlling a cooking apparatus having a plurality of induction heating coils installed under a cooking plate includes identifying induction heating coils among the plurality of induction heating coils based on a plurality of groups to which the plurality of induction heating coils belong, respectively, and supplying, by a plurality of drivers, driving power to the plurality of groups of the plurality of induction heating coils, respectively. Power output by a first driver, among the plurality of drivers, driving a first group among the plurality of groups may be increased and power output by a second driver, among the plurality of drivers, driving a second group among the plurality of groups may be decreased.

The supplying, by a plurality of drivers, of the driving power to the plurality of groups may include assigning the plurality of groups to the plurality of drivers, respectively, and identifying power output by each of the plurality of drivers based on a number of the plurality of induction heating coils belonging to each of the plurality of groups. The power output by each of the plurality of drivers may be not disproportional to the number of the plurality of induction heating coils belonging to the each of the plurality of groups.

The method may further include identifying offset power to regulate power output by the first driver and the second driver.

The identifying of the offset power may include identifying the offset power based on a total power output by all the plurality of drivers.

The identifying of the offset power may include identifying the offset power based on a difference between the power output by the first driver and the power output by the second driver.

The method may further include increasing the power output by the first driver by the offset power, and decreasing the power output by the second driver by the offset power.

The induction heating coils among the plurality of induction heating coils, are divided into the plurality of groups, respectively, based on positions of the induction heating coils which overlap with a position of a cookware placed on the cooking plate.

The first group may include an induction heating coil, an entirety of which overlaps with the position of the cookware and the second group may include an induction heating coil, at least portion of which is outside the position of the cookware.

In accordance with one aspect of the present disclosure, a cooking apparatus includes a cooking plate, a plurality of induction heating coils installed under the cooking plate, a first driver and a second driver configured to supply driving power to the plurality of induction heating coils, and a controller configured to control the first driver and the second driver to respectively drive induction heating coils belonging to a first group and a second group to which the induction heating coils among the plurality of heating coils belong. A ratio of power output by the first driver and power output by the second driver may be different from a ratio of the number of induction heating coils belonging to the first group and the number of induction heating coils belonging to the second group.

The first group may include an induction heating coil, an entirety of which overlaps with the cookware and the second group may include an induction coil, at least portion of which is outside a position of a cookware placed on the cooking plate.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

The principle and embodiments of the present invention will now be described with reference to accompanying drawings.

Figure 1:
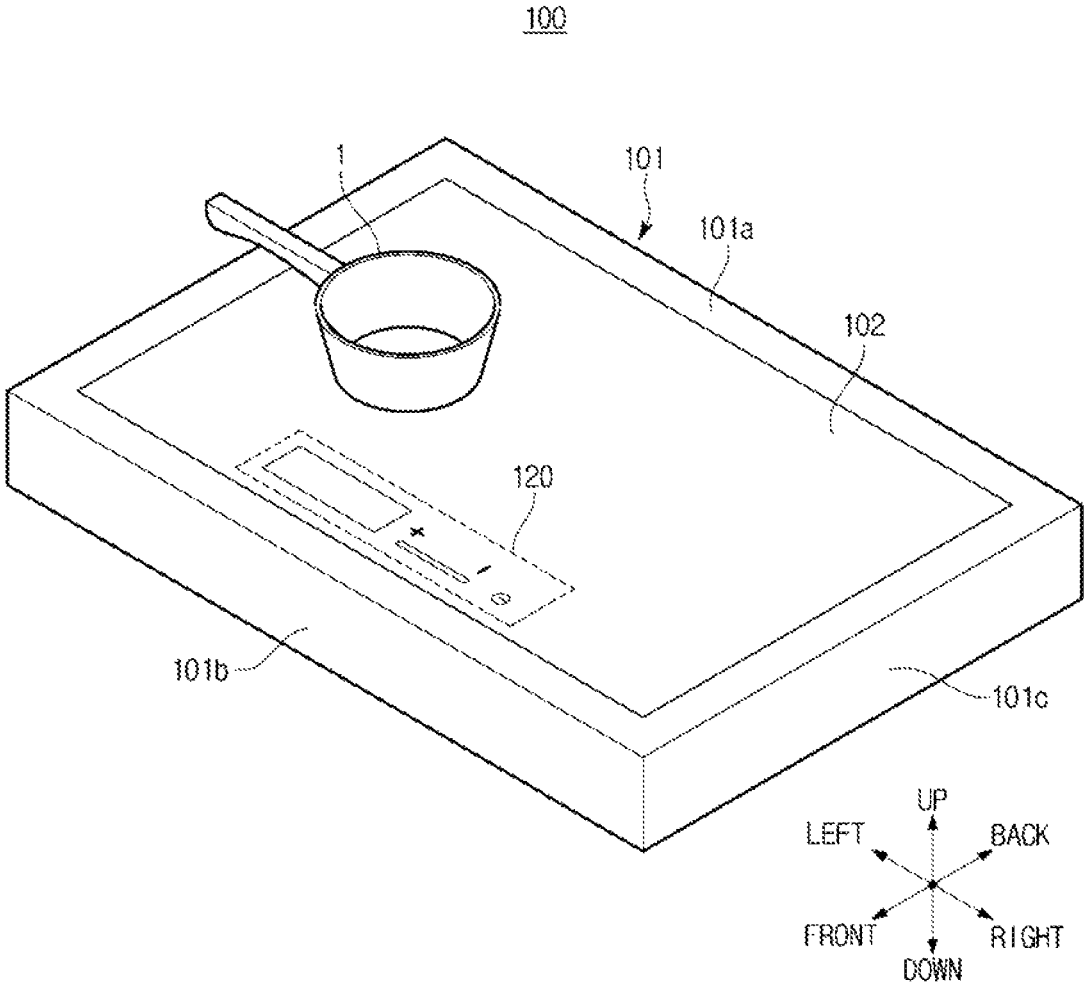
FIG. 1 shows the exterior of a cooking apparatus, according to an embodiment of the present disclosure.
Figure 2:
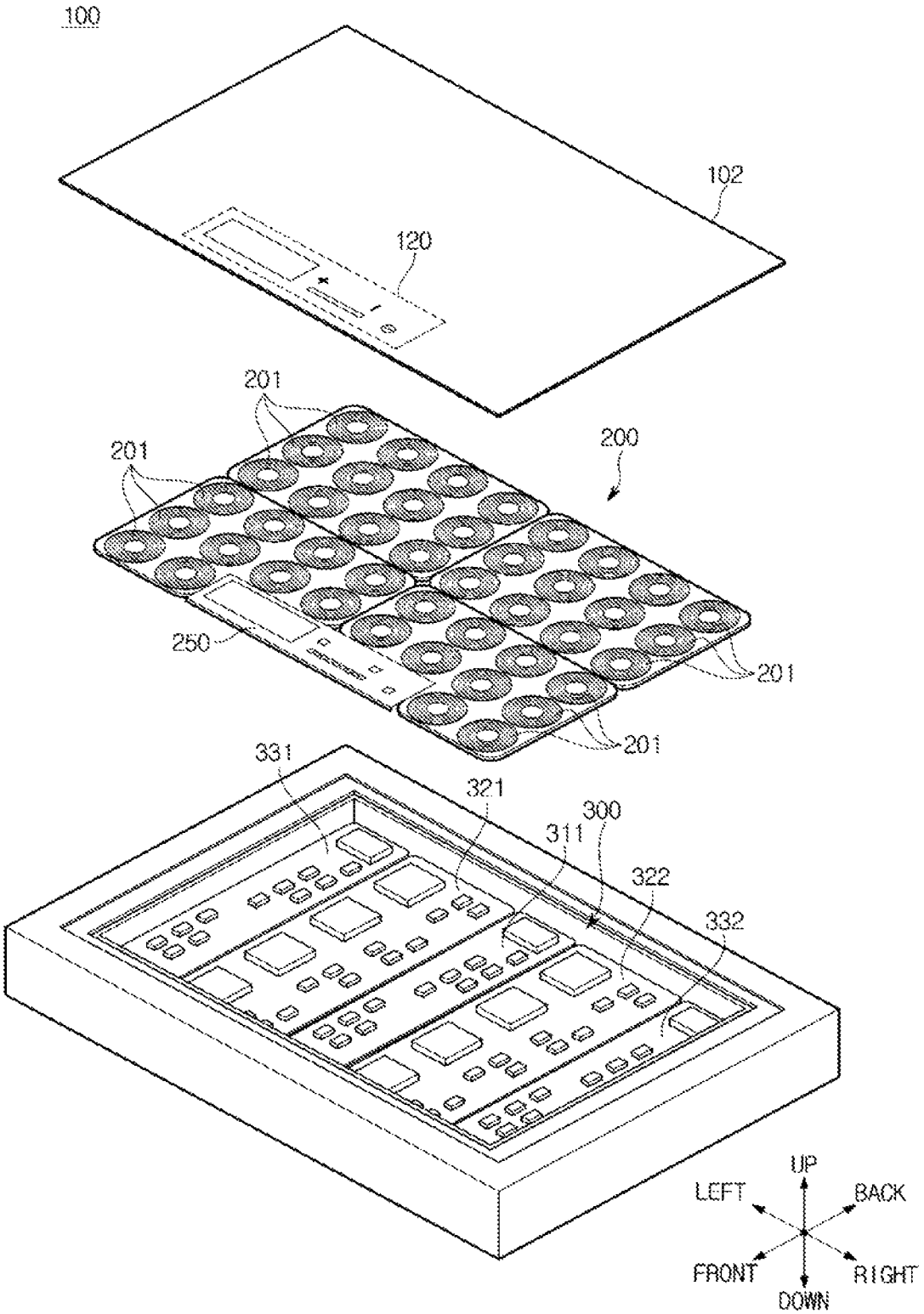
FIG. 2 shows the interior of a cooking apparatus, according to an embodiment of the present disclosure.
Figure 3:
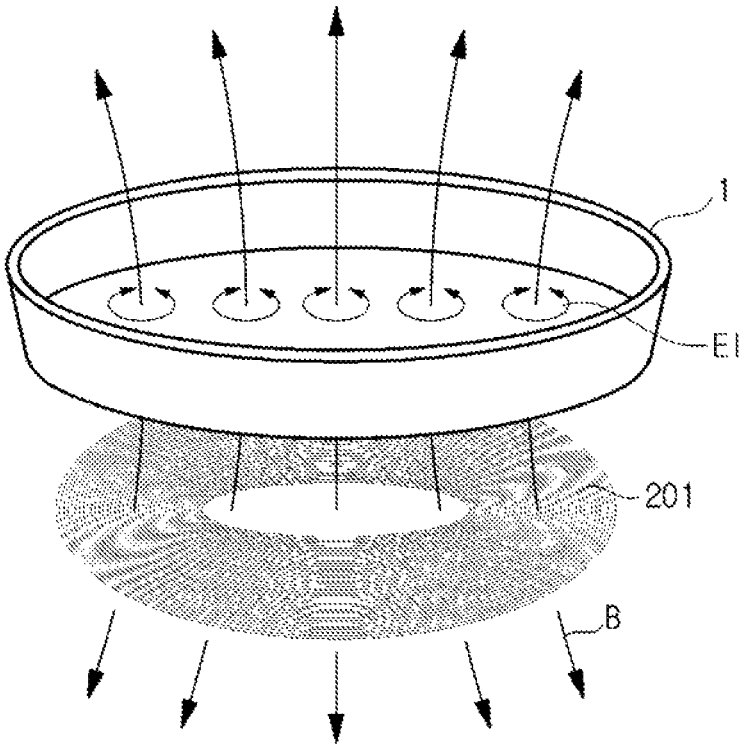
FIG. 3 shows how a cooking apparatus heats the cookware, according to an embodiment of the present disclosure.

FIG. 1 shows the exterior of a cooking apparatus, according to an embodiment of the present disclosure. FIG. 2 shows the interior of a cooking apparatus, according to an embodiment of the present disclosure. FIG. 3 shows how a cooking apparatus heats the cookware, according to an embodiment of the present disclosure.

Referring to FIGS. 1, 2 and 3, a cooking apparatus 100 may include a main body 101 forming the exterior of the cooking apparatus 100 and equipped with various parts to constitute the cooking apparatus 100.

A cooking plate 102 in the form of a flat plate may be provided on the top 101*a* of the main body 101 to have cookware 1 put thereon. To avoid being easily broken, the cooking plate 102 may be made of tempered glass, such as ceramic glass.

On one side of the cooking plate 102, a user interface 120 may be provided to receive control commands from the user and display operation information of the cooking apparatus 100 for the user. The position of the user interface 120 is not, however, limited onto the cooking plate 102, but may be any position on the front 101*b* and/or side 101*c* of the main body 101.

As shown in FIG. 2, there may be a heating layer 200 including a plurality of induction heating coils 201 for heating the cookware 1 and a main assembly 250 for implementing the user interface 120 provided under the cooking plate 102.

Each of the plurality of induction heating coils 201 may produce a magnetic field and/or electromagnetic field for heating the cookware 1.

For example, when a driving current is applied to the induction heating coil 201, a magnetic field B may be induced around the induction heating coil 201, as shown in FIG. 3. Especially, when a current that alternates in magnitude and direction over time, i.e., an alternate current (AC) is applied to the induction heating coil 201, a magnetic field B changing in magnitude and direction over time may be induced around the induction heating coil 201.

The magnetic field B around the induction heating coil 201 may pass through the cooking plate 102 made of tempered glass and reach the cookware 1 placed on the cooking plate 102.

Due to the magnetic field B changing in magnitude and direction over time, eddy currents EI circulating around the magnetic field B may be induced in the cookware 1. As such, a phenomenon in which a time-varying magnetic field induces eddy currents is called a law of electromagnetic induction. The eddy currents EI may cause electrical resistance heat in the cookware 1. The electrical resistance heat is heat generated in a resistor when a current flows in the resistor, and is also called Joule Heat. The cookware 1 may be heated by the electrical resistance heat, and the food contained in the cookware 1 may also be heated.

Each of the plurality of induction heating coils 201 is able to heat the cookware 1 by the law of electromagnetic induction and the electrical resistance heat. The plurality of induction heating coils 201 may be arranged underneath the cooking plate 102 in a predetermined pattern. For example, as shown in FIG. 2, the plurality of induction heating coils 201 may be arranged in columns and rows like a matrix. In other words, the plurality of induction heating coils 201 may be arranged from front to back and from right to left of the main body 101 at predetermined intervals.

The arrangement of the plurality of induction heat coils 201 is not limited to what is shown in FIG. 2, and the plurality of induction heating coils 201 may be arranged in many different forms. For example, the plurality of induction heating coils 201 may be arranged in the form of a hive to minimize the gap between the induction heating coils 201.

The main assembly 250 may be provided underneath the user interface 120 located on one side of the cooking plate 102 to implement the user interface 120. The main assembly 250 may be a printed board assembly (PBA) including a display, switching devices, integrated circuit (IC) devices, and a printed circuit boards having the display, switching devices, and IC devices mounted thereon to implement the user interface 120.

The position of the main assembly 250 is not limited to what is shown in FIG. 2, but may be anywhere. For example, in a case that the user interface 120 is installed on the front 101*b* of the main body 101, the main assembly 250 may be located behind the front 101*b* of the main body 101 separately from the heating layer 200.

A driving layer 300 including a plurality of PBAs 311, 321, 322, 331, and 332 to implement circuits for applying driving currents to the plurality of induction heating coils 201 may be arranged under the heating layer 200.

The driving layer 300 may include the plurality of PBAs 311, 321, 322, 331, and 332, as shown in FIG. 2, and each of the plurality of PBAs 311, 321, 322, 331, and 332 may include switching devices, IC devices, and a PCB having the devices mounted thereon.

For example, the plurality of PBAs 311, 321, 322, 331, and 332 may include a sub assembly 311 having detection circuits installed therein to detect the presence of the cookware 1 and the temperature of the cookware 1, driving assemblies 321, 322 having driving circuits installed therein to apply driving currents to the plurality of induction heating coils 201, and power assemblies 331 and 332 having power circuits installed therein to supply power to the driving circuits.

As such, with the detection circuit, the driving circuit and the power circuit installed in separate PBAs, assemblability may be improved in a manufacturing process of the cooking apparatus 100. In other words, in comparison with the detection circuit, the driving circuit and the power circuit installed in a single PBA, installing the detection circuit, the driving circuit and the power circuit in the sub assembly 311, the driving assemblies 321 and 322, and the power assemblies 331 and 332, respectively, makes it easy to manufacture the PBAs. Furthermore, it is easy to assemble several PBAs in small sizes into the main body as compared with assembling a large size of PCB assembly into the main body.

With the detection circuit, the driving circuit and the power circuit installed in separate PBAs, it is easy to manage and maintain the cooking apparatus 100. For example, even if a malfunction occurs in one of the PBAs, the malfunctioning PBA may be selectively replaced.

Furthermore, with the detection circuit, the driving circuit and the power circuit installed in separate PBAs, interference among the circuits may be reduced. For example, since the detection circuit is spatially separated from the power circuit that supplies AC power, noise from the power circuit to the detection circuit may be noticeably reduced.

The cooking apparatus 100 includes many induction heating coils 201 (in an example as shown in FIG. 2, there are 44 induction heating coils 201). Considering this, it is inefficient to use a single driving circuit to apply the driving current to all the induction heating coils 201.

Accordingly, the cooking apparatus 100 may include a plurality of driving circuits, which may be installed in the plurality of driving assemblies 321 and 322. For example, two driving circuits may be installed in the two driving assemblies 321 and 322.

The induction heating coils 201 are greater in number (which is 44 in the example of FIG. 2) than the driving assemblies 321 and 322 (which is 2 in the example of FIG. 2).

Accordingly, the induction heating coils 201 may be divided into as many groups as the number of the driving assemblies 321 and 322. For example, the cooking apparatus 100 may divide the induction heating coils 201 into two groups for the two driving assemblies 321 and 322 to apply driving currents to the 44 induction heating coils 201. In another example, the cooking apparatus 100 may determine which induction heating coils overlap with the cookware 1, and divide the induction heating coils overlapping with the cookware 1 into two groups. The two driving assemblies 321 and 322 may each drive induction heating coils 201 belonging to one of the two groups.

The number of the driving assemblies and the number of the groups are not limited to what are shown in FIG. 2, but may vary by the number of the induction heating coils, the size of the cooking apparatus 100, the size of devices constituting the driving circuit, the magnitude of a driving current applied to each of the induction heating coils, and the magnitude of a current that each driving assembly is able to output. For example, if the size of the cooking apparatus 100 expands and the number of the induction heating coils increases, four driving circuits may be installed respectively in four driving assemblies. On the other hand, if the size of the cooking apparatus 100 is even bigger and the number of the induction heating coils increases, each driving circuit may be installed in each of six or eight driving assemblies.

The driving assemblies 321 and 322 may be arranged on either side of the sub assembly 311. For example, the first driving assembly 321 may be arranged on the left side of the sub assembly 311, and the second driving assembly 322 may be arranged on the right side of the sub assembly 311.

The power circuits may be installed in the two power assemblies 331 and 332. Two power assemblies 331 and 332 may be arranged on both sides of the driving assemblies 321 and 322 to supply AC power to the driving assemblies 321 and 322 arranged on both sides of the sub assembly 311. For example, the first power assembly 331 may be arranged on a side of the first driving assembly 321, and the second power assembly 332 may be arranged on a side of the second driving assembly 322.

As described above, the cooking apparatus 100 may include the plurality of induction heating coils 201 to heat the cookware 1, and the detection circuit, the driving circuit, and the power circuit to apply a driving current to the induction heating coil 201. The detection circuit, the driving circuit, and the power circuit may be installed in the plurality of PBAs 311, 321, 322, 331, and 332, which are separated from one another. As the detection circuit, the driving circuit, and the power circuit are installed in the plurality of PBAs 311, 321, 322, 331, and 332, it may become easier to manufacture and assemble the PBAs 311, 321, 322, 331, and 332 and the productivity of the cooking apparatus 1 may be improved.

The structure and functions of the cooking apparatus 100 has thus far been briefly described. Configurations and the associated functions of the cooking apparatus 100 will now be described in detail.

Figure 4:
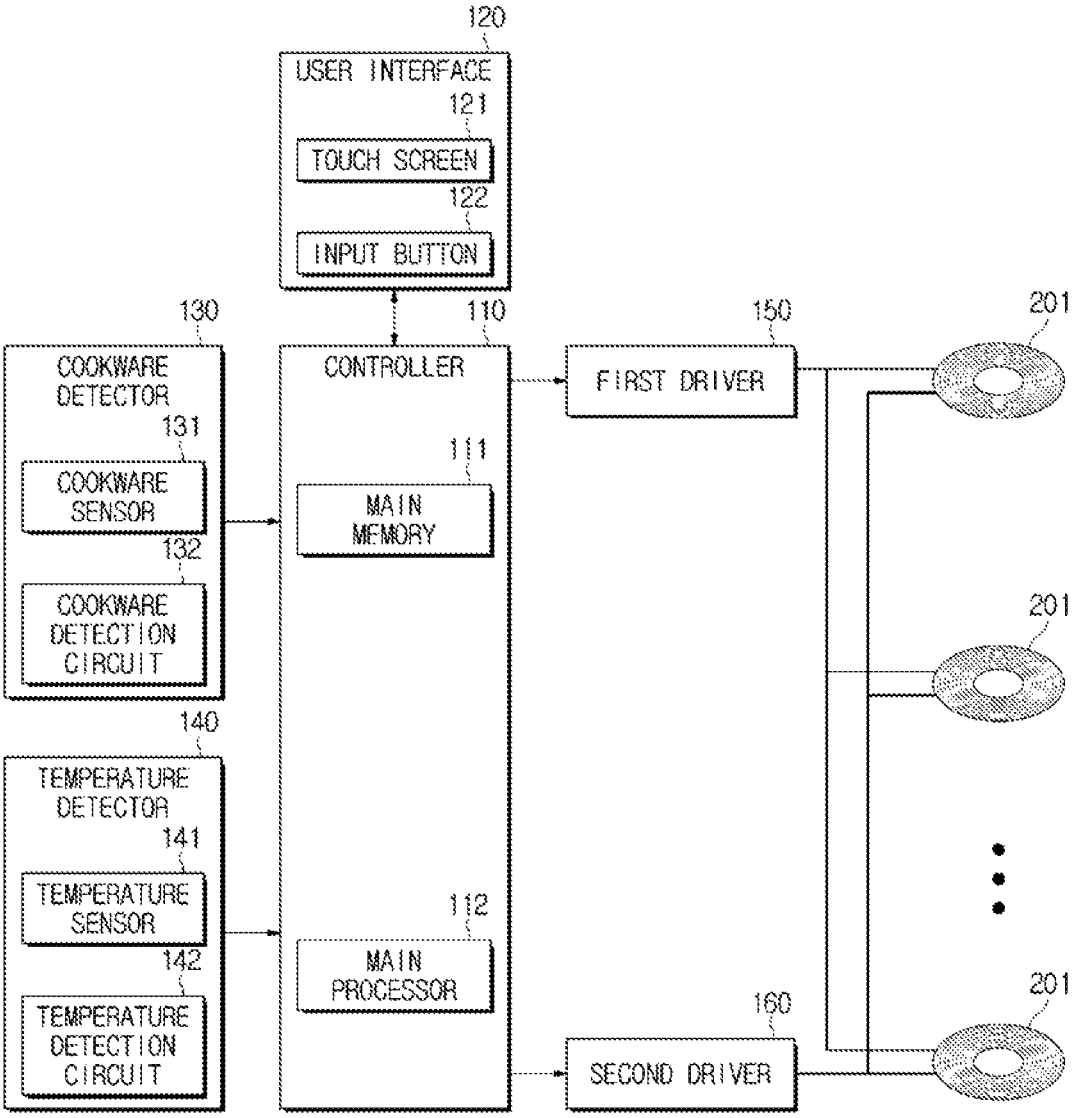
FIG. 4 is a block diagram of a cooking apparatus, according to an embodiment of the present disclosure.
Figure 5:
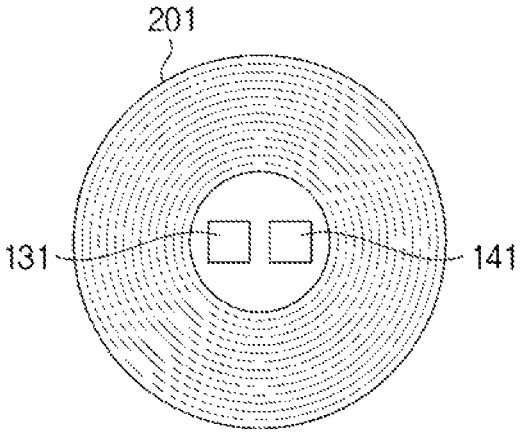
FIG. 5 shows an induction heating coil, a cookware sensor, and a temperature sensor included in a cooking apparatus, according to an embodiment of the present disclosure.
Figure 6:
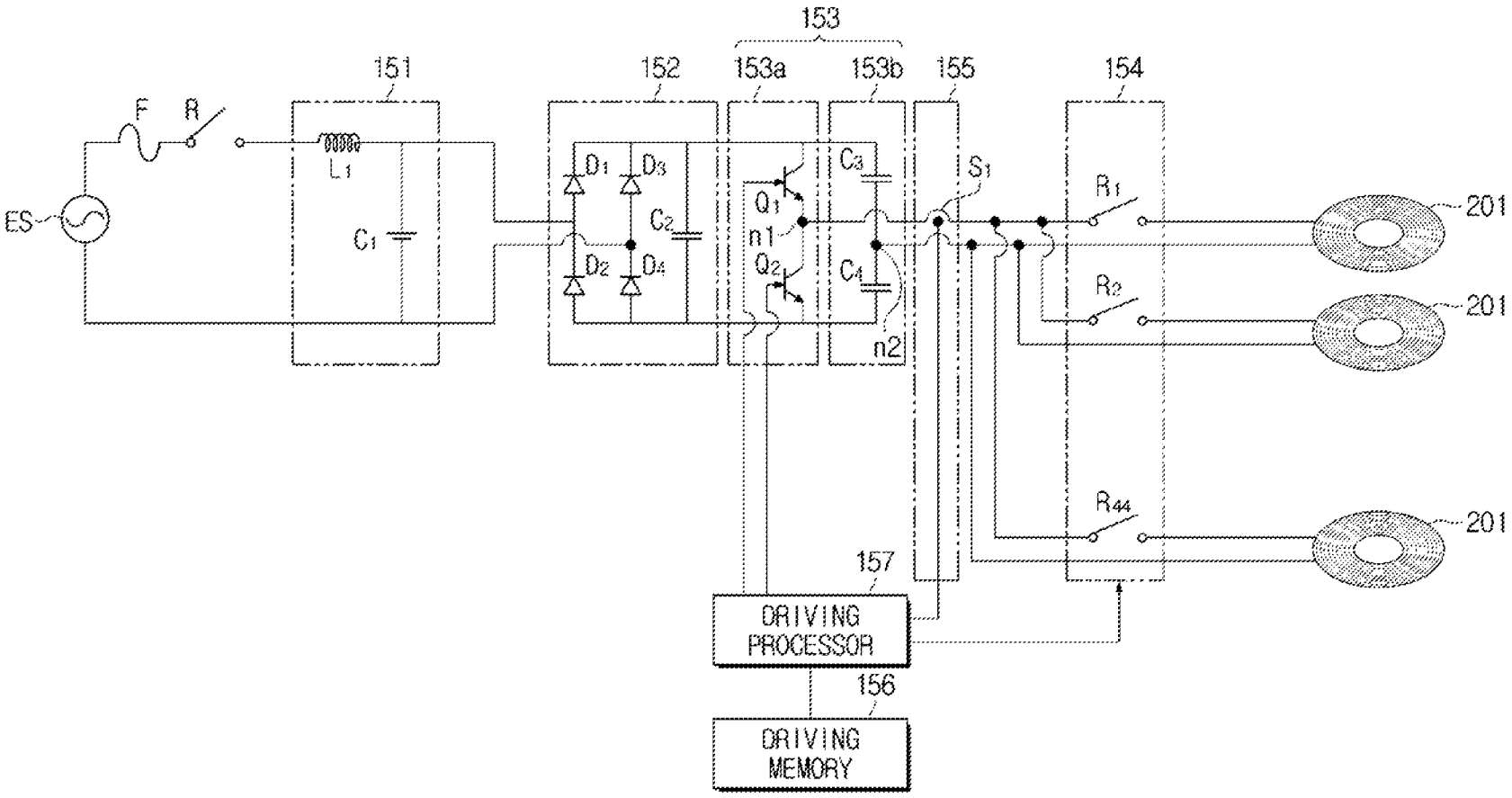
FIG. 6 shows a driver included in a cooking apparatus, according to an embodiment of the present disclosure.
Figure 7:
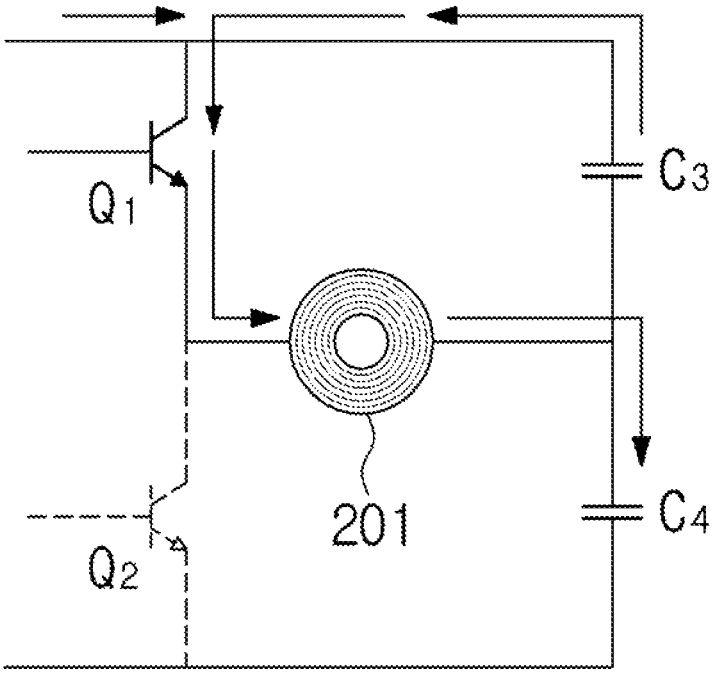
FIGS. 7 and 8 show current flows in a driver and an induction heating coil included in a cooking apparatus, according to an embodiment of the present disclosure.
Figure 8:
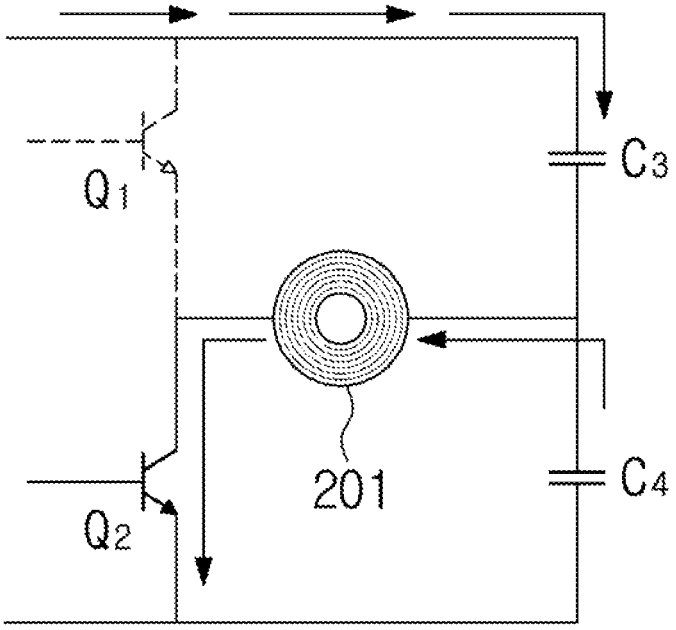
Figure 9:
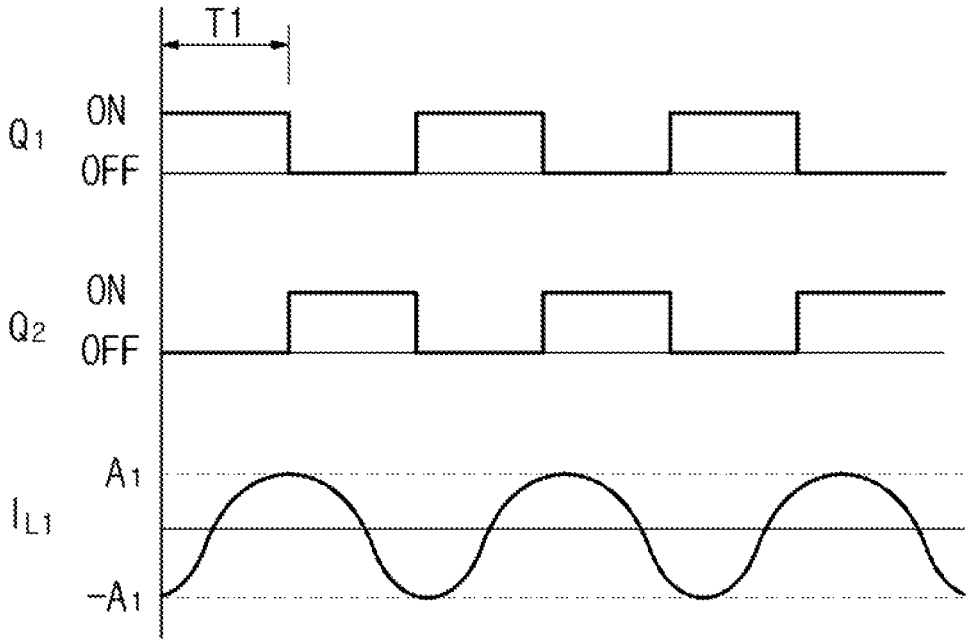
FIGS. 9 and 10 show the magnitude of a current flowing in an induction heating coil in switching cycles of a driver included in a cooking apparatus, according to an embodiment of the present disclosure.
Figure 10:
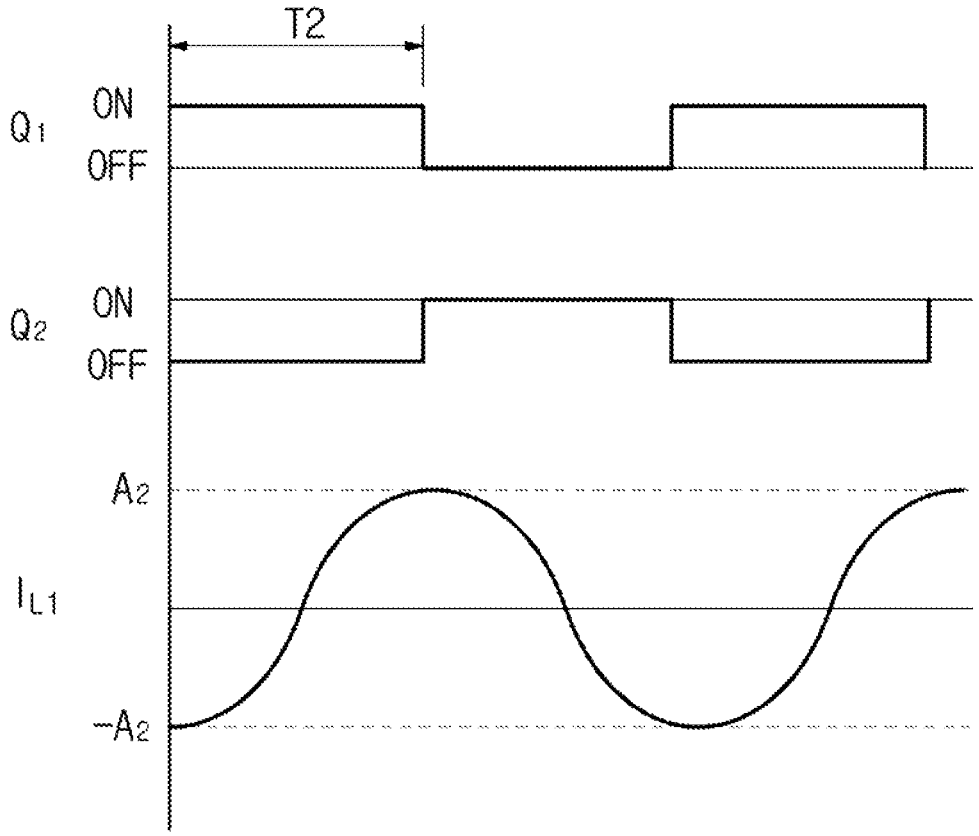
Figure 11:
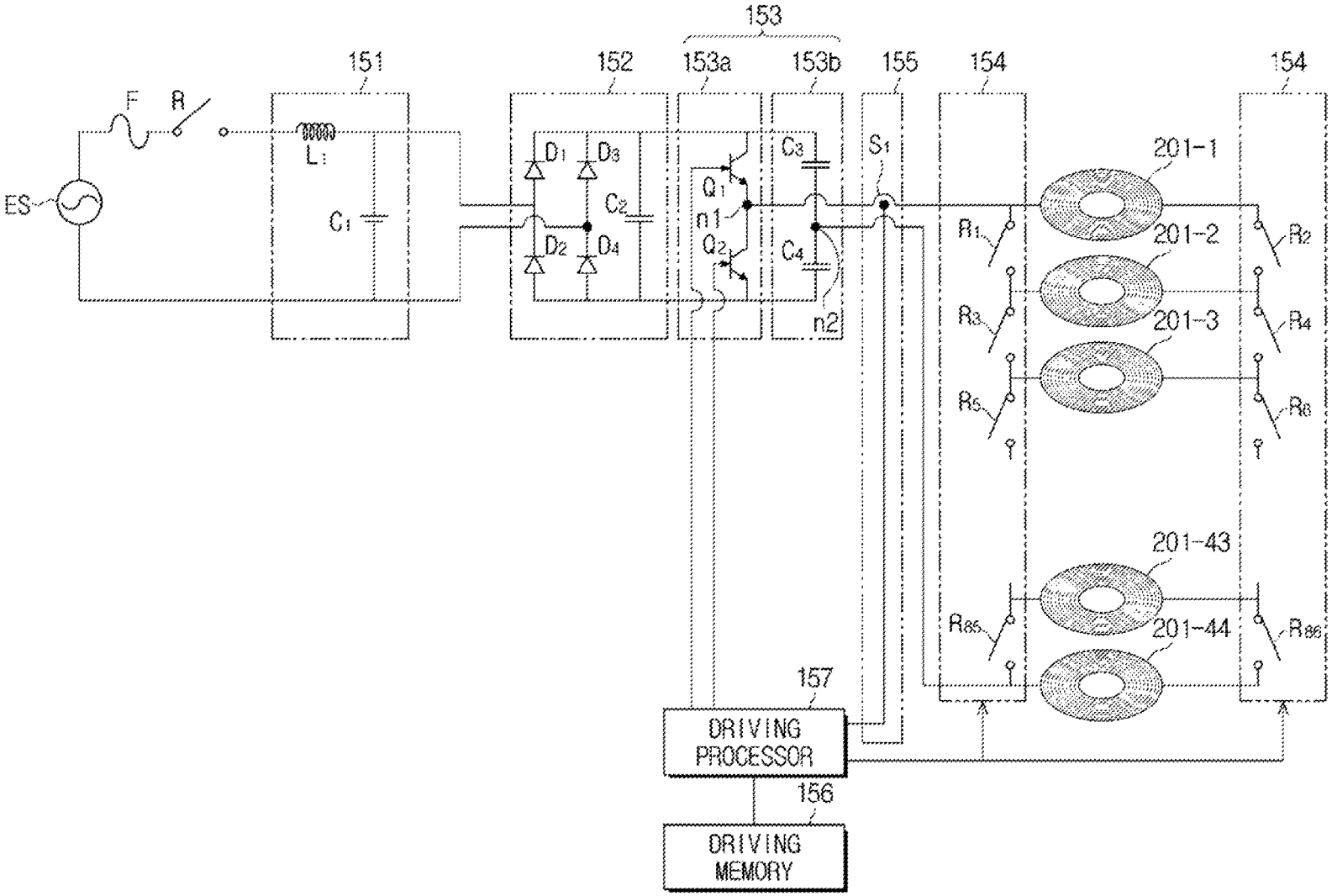
FIG. 11 shows a driver included in a cooking apparatus, according to another embodiment of the present disclosure.

FIG. 4 is a block diagram of a cooking apparatus, according to an embodiment of the present disclosure. FIG. 5 shows an induction heating coil, a cookware sensor, and a temperature sensor included in a cooking apparatus, according to an embodiment of the present disclosure. FIG. 6 shows a driver included in a cooking apparatus, according to an embodiment of the present disclosure. FIGS. 7 and 8 show current flows in a driver and an induction heating coil included in a cooking apparatus, according to an embodiment of the present disclosure. FIGS. 9 and 10 show the magnitude of a current flowing in an induction heating coil in switching cycles of a driver included in a cooking apparatus, according to an embodiment of the present disclosure. FIG. 11 shows a driver included in a cooking apparatus, according to another embodiment of the present disclosure.

Referring to FIGS. 4 to 11, the cooking apparatus 100 may include a plurality of induction heating coils 201, the user interface 120, a cookware detector 130, a temperature detector 140, a first driver 150, a second driver 160, and a controller 110.

As described above, each of the plurality of induction heating coils 201 may produce a magnetic field and/or electromagnetic field for heating the cookware 1. The user interface 120 may include a touch screen 121 for receiving a touch input from the user and displaying an image of an operation of the cooking apparatus 100 in response to the touch input from the user, and an input button 122 for receiving control commands from the user.

The touch screen 121 may include a touch panel for receiving a touch input from the user, a display panel for displaying an image of an operation of the cooking apparatus 100, and a touch screen controller for controlling operations of the touch panel and the display panel.

The touch screen 121 may display an image of an operation of the cooking apparatus 100 and output a touch input of the user to the controller 110. It may also receive information about an operation of the cooking apparatus 100 from the controller 110 and display an image corresponding to the received information.

The input button 122 may include a plurality of buttons to receive predetermined control commands from the user and output electric signals corresponding to the control commands from the user to the controller 110. For example, the input button 122 may include a start button to receive a command to power on or off the cooking apparatus 100, a power up button and a power down button to receive commands to increase and decrease intensity of the magnetic field and/or the electromagnetic field produced by the cooking apparatus 100, respectively.

The input button 122 may be implemented in various forms of button (or switch), such as a push button, a slide button, a toggle button, a touch button, a dial, etc.

As such, the user interface 120 may receive a control command from the user and output an electric signal corresponding to the control command to the controller 110. It may also receive information about an operation of the cooking apparatus 100 from the controller 110 and display an image corresponding to the received information.

For example, the user interface 120 may display an image representing a position of the cookware 1 detected by the cookware detector 130 on the touch screen 121. The user interface 120 may also receive a touch input of the user selecting the cookware 1 through the touch screen 121 and output the touch input of the user to the controller 110. When the user inputs a command to increase output (power up command) of the cooking apparatus 100 through the input button 122, the user interface 120 may output the power up command to the controller 110, and when the user inputs a command to decrease output (power down command) of the cooking apparatus 100 through the input button 122, the user interface 120 may output the power down command to the controller 110.

The cookware detector 130 may detect the position of the cookware 1 put on the cooking plate 102. The cookware 1 may be placed anywhere on the cooking plate 102. For efficient operation, the cooking apparatus 100 may detect a position of the cookware 1 on the cooking plate 102 and selectively activate the induction heating coil 201 corresponding to the position of the cookware 1.

The cookware detector 130 may include a plurality of cookware sensors 131 for detecting the position of the cookware 1, and a cookware detection circuit 132 for processing an output of the cookware sensor 131 and outputting information about the position of the cookware 1 to the controller 110.

The plurality of cookware sensors 131 may be installed around the plurality of induction heating coils 201 to detect the cookware 1 positioned to overlap some of the induction heating coils 201. For example, the cookware sensor 131 may be located in the center of the induction heating coil 201, as shown in FIG. 5, for detecting the cookware 1 positioned to cover the center of the induction heating coil 201. The position of the cookware sensor 131 is not limited to what is shown in FIG. 5, but may be any place around the induction heating coil 201.

The cookware sensor 131 may include a capacity sensor for detecting the cookware 1. Specifically, the cookware sensor 131 may detect a change in capacitance due to the cookware 1. The cookware sensor 131 is not, however, limited to the capacitance sensor, but may include various sensors capable of detecting the cookware 1 put on the cooking plate 102, such as infrared switches, weight sensors, microswitches, membrane switches, etc.

The cookware sensor 131 may output information about detection of the cookware 1 to the cookware detection circuit 132.

The cookware detection circuit 132 may receive a result of detection of the cookware 1 from the plurality of cookware sensors 131 and determine from the detection result the position where the cookware 1 is placed, i.e., an induction heating coil overlapping the cookware 1.

The cookware detection circuit 132 may include a multiplexer for sequentially receiving the detection result from the plurality of cookware sensors 131 (e.g., 44 cookware sensors in the embodiment shown in FIG. 2), and a microprocessor for processing the detection result of the plurality of cookware sensors 131.

The cookware detection circuit 132 may output cookware position data resulting from processing the detection result of the plurality of cookware sensors 131 to the controller 110.

In this way, the cookware detector 130 may determine which induction heating coil 201 overlaps with the cookware 1 and output the determination result to the controller 110. The controller 110 may display the position of the cookware 1 on the user interface 120 based on the detection result of the cookware detector 130.

Optionally, the cookware detector 131 may be omitted and the controller 110 may directly determine which induction heating coil overlaps with the cookware 1. For example, the cooking apparatus 100 may determine which induction heating coil overlaps with the cookware 1 based on a change in inductance of the induction heating coil 201 due to approaching of the cookware 1.

The controller 110 may control the first and second drivers 150 and 160 to output detection signals to the plurality of induction heating coils 201 at predetermined intervals to detect the cookware 1. Furthermore, the controller 110 may control the first and second drivers 150 and 160 to detect a current flowing in each of the plurality of induction heating coils 201 due to the detection signal.

The inductance of an induction heating coil that is overlapping with the cookware 1 is different from the inductance of an induction heating coil that is not occupied by the cookware 1. For example, the inductance of an induction heating coil overlapping with the cookware 1 is larger than the inductance of an induction heating coil not occupied by the cookware 1. This is because the coil inductance is proportional to magnetic permeability of a surrounding medium (especially, a medium in the center of the coil) and the permeability of the cookware 1 is typically larger than that of air.

Furthermore, an AC current flowing in an induction heating coil overlapping with the cookware 1 is smaller than that in an induction heating coil not occupied by the cookware 1.

Accordingly, the controller 110 may determine which induction heating coil overlaps with the cookware 1 by measuring the magnitude of the AC current flowing in the induction heating coil 201 and comparing the measured current magnitude with a reference current magnitude. Specifically, if the measured current magnitude is smaller than the reference current magnitude, the controller 110 may determine that the induction heating coil overlaps with the cookware 1.

Determining of which induction heating coil overlaps with the cookware 1 is not, however, limited thereto, and the determination may be made by measuring the frequency, the phase, etc., of the AC current flowing in the induction heating coil 201.

The temperature detector 140 may detect the temperature of the cookware 1 placed on the cooking plate 102. The cookware 1 may be heated by the induction heating coil 201 and may be overheated depending on the material of the cookware 1. Accordingly, the cooking apparatus 100 may detect the temperature of the cookware 1 placed on the cooking plate 102 and deactivate the induction heating coil 201 when the cookware 1 is overheated, for safety.

The cookware detector 140 may include a plurality of temperature sensors 141 for detecting the temperature of the cookware 1, and a temperature detection circuit 142 for processing an output of the temperature sensor 141 and outputting information about the temperature of the cookware 1 to the controller 110.

The plurality of temperature sensors 141 are arranged around the plurality of induction heating coils 201 to measure the temperature of the cookware 1 heated by the induction heating coils 201. For example, the temperature sensor 141 may be located in the center of the induction heating coil 201, as shown in FIG. 5, for directly measuring the temperature of the cookware 1 or measuring the temperature of the cooking plate 102, from which the temperature of the cookware 1 may be estimated. The position of the temperature sensor 141 is not, however, limited to what is shown in FIG. 5, but may be any place around the induction heating coil 201.

For example, the temperature sensor 141 may include a thermistor whose electric resistance is changed according to the temperature.

The temperature sensor 141 may output a signal indicating the temperature of the cookware 1 or the cooking plate 102 to the temperature detection circuit 142.

The temperature detection circuit 142 may receive signals indicating the temperature of the cookware 1 from the plurality of temperature sensors 141 and determine the temperature of the cookware 1 from the received signals.

The temperature detection circuit 142 may include a multiplexer for sequentially receiving the signals indicating the temperature from the plurality of temperature sensors 141, for example, 44 temperature sensors 141 as shown in FIG. 2, and an analog-to-digital converter (ADC) for converting the signal indicating the temperature to digital temperature data.

The temperature detection circuit 142 may process the signal indicating the temperature of the cookware 1 output from the plurality of temperature sensors 141 and send the derived temperature data to the controller 110.

In this way, the temperature detector 140 may detect the temperature of the cookware 1 and output the detection result to the controller 110. The controller 110 may determine whether the cookware 1 is overheated based on the detection result of the temperature detector 140, and stop heating the cookware 1 if it is determined that the cookware 1 is overheated.

The first and second drivers 150 and 160 may each receive power from an external power source and apply a current to the induction heating coil 201 according to a driving control signal from the controller 110. The first and second drivers 150 and 160 may be respectively installed in a plurality of driving assemblies 321 and 322. For easier understanding, the first driver 150 of the first and second drivers 150 and 160 will now be focused. It may be assumed that the second driver 160 is the same as the first driver 150.

The first driver 150 may include an electromagnetic interference (EMI) filter 151, a rectifying circuit 152, an inverter circuit 153, a distribution circuit 154, a current detection circuit 155, a driving memory 156, and a driving processor 157.

The EMI filter 151 cuts off high-frequency noise included in the AC power (e.g., harmonics of AC power) supplied from an external power source ES while passing a predetermined frequency (e.g., 50 Hz or 60 Hz) of AC voltage and AC current.

The EMI filter 151 may include an inductor L1 arranged between input and output terminals of the EMI filter 151 and a capacitor C1 arranged between a positive output terminal and a negative output terminal of the EMI filter 151. The inductor L1 may block passage of the high-frequency noise, and the capacitor C1 may bypass the high-frequency noise to the external power source ES.

Furthermore, there may be a fuse F and a relay R arranged between the EMI filter 151 and the external power source ES to cut off overcurrents.

The AC power with the high-frequency noise blocked by the EMI filter 151 may be supplied to the rectifying circuit 152.

The rectifying circuit 152 may convert the AC power to direct current (DC) power. Specifically, the rectifying circuit 152 may convert AC voltage alternating in magnitude and polarity (alternating between positive voltage and negative voltage) over time to DC voltage having constant magnitude and polarity, and convert an AC current alternating in magnitude and direction (alternating between positive current and negative current) over time to a DC current having constant magnitude.

The rectifying circuit 152 may include a bridge diode. For example, the rectifying circuit 152 may include four diodes D1, D2, D3, and D4. The diodes D1, D2, D3, and D4 form diode pairs, each diode pair having two diodes connected in series, and the two diode pairs may be connected in parallel to each other. The bridge diode may convert an AC voltage that changes in polarity over time to a positive DC voltage with constant polarity, and convert an AC current that changes in direction over time to a positive current with constant direction.

Furthermore, the rectifying circuit 152 may include a DC link capacitor C2. The DC link capacitor C2 may convert the positive voltage that changes magnitude over time to a DC voltage with the constant magnitude.

In this way, the rectifying circuit 152 may have an input of AC voltage and AC current from the EMI filter 151 and output a DC voltage and DC current.

The inverter circuit 153 may include a switching circuit 153*a* to apply or cut off the driving current to the induction heating coil 201, and a resonance circuit 153*b* to cause resonance with the induction heating coil 201.

The switching circuit 153*a* may include a first switch Q1 and a second switch Q2, which may be connected in series between positive and negative output lines of the rectifying circuit 152.

The first and second switches Q1 and Q2 may each be turned on or off according to a driving control signal from the driving processor 157. Depending on whether each of the first and second switches Q1 and Q2 is turned on or off, a driving current may flow out to the induction heating coil 201 through the first switch Q1 and/or the second switch Q2 or a driving current may flow in from the induction heating coil 201 through the first switch Q1 and/or the second switch Q2.

For example, as shown in FIG. 7, when the first switch Q1 is closed (turned on) and the second switch Q2 is opened (turned off), the current may flow to the induction heating coil 201 through the first switch Q1. Moreover, as shown in FIG. 8, when the first switch Q1 is opened (turned off) and the second switch Q2 is closed (turned on), the current may flow from the induction heating coil 201 through the second switch Q2.

Since the first switch Q1 and the second switch Q2 are turned on or off at high speed of 20 kilohertz (kHz) to 70 kHz, the first and second switches Q1 and Q2 may include fast respondent three-terminal semiconductor device switches. For example, the first and second switches Q1 and Q2 may each employ a bipolar junction transistor BJT, a metal-oxide-semiconductor field effect transistor (MOSFET), insulated gate bipolar transistor (IGBT), thyristor, or the like.

The resonance circuit 153*b* may include a first resonant capacitance C3 and a second resonant capacitance C4, which may be connected in series between the positive line P and the negative line N.

Depending on whether each of the first and second switches Q1 and Q2 is turned on or off, a current may be output from the first resonant capacitor C3 and/or the second resonant capacitor C4 to the induction heating coil 201, or a current may be input from the induction heating coil 201 to the first resonant capacitor C3 and/or the second resonant capacitor C4.

For example, as shown in FIG. 7, when the first switch Q1 is closed (turned on) and the second switch Q2 is opened (turned off), the current may be applied from the induction heating coil 201 to the first resonant capacitor C3 and/or the second resonant capacitor C4. Moreover, as shown in FIG. 8, when the first switch Q1 is opened (turned off) and the second switch Q2 is closed (turned on), the current may be applied to the induction heating coil 201 from the first resonant capacitor C3 and/or the second resonant capacitor C4.

In this way, the inverter circuit 153 may control the current to be applied to the induction heating coil 201. Specifically, depending on whether each of the first switch Q1 and the second switch Q2 included in the inverter circuit 153 is turned on or off, the current flowing in the induction heating coil 201 may be changed in magnitude and direction. That is, an AC current may be applied to the induction heating coil 201.

For example, as shown in FIG. 7, when the first switch Q1 is closed (turned on) and the second switch Q2 is opened (turned off), the current applied from the rectifying circuit 152 may be applied to the induction heating coil 201 through the first switch Q1. The current applied to the induction heating coil 201 is applied to the second resonant capacitor C4 through the induction heating coil 201, and the electric energy is stored in the second resonant capacitor C4. At this time, a positive current (flowing from the left to the right of the induction heating coil as shown in FIG. 7) may flow in the induction heating coil 201. As the electric energy is stored in the second resonant capacitor C4, a current may be applied to the induction heating coil 201 from the first resonant capacitor C3 through the first switch Q1.

Moreover, as shown in FIG. 8, when the first switch Q1 is opened (turned off) and the second switch Q2 is closed (turned on), the current may be applied to the induction heating coil 201 from the second resonant capacitor C4. The current applied to the induction heating coil 201 may flow to the rectifying circuit 152 through the induction heating coil 201 and the second switch Q2. At this time, a negative current (flowing from the right to the left of the induction heating coil as shown in FIG. 8) may flow in the induction heating coil 201. As the current is output from the second resonant capacitor C4, the electric energy stored in the second resonant capacitor C4 is reduced, and a current may be applied to the first resonant capacitor C3 from the rectifying circuit 152.

The magnitude of the current applied to the induction heating coil 201 may vary and the intensity of a magnetic field produced by the induction heating coil 201 may vary by the turn-on/off frequency of the first and second switches Q1 and Q2.

For example, as shown in FIG. 9, when the first switch Q1 is turned on and the second switch Q2 is turned off, the current applied to the induction heating coil 201 (the current flowing in the induction heating coil 201) may increase from negative to positive. The current applied to the induction heating coil 201 may increase to a first amplitude A1 for a first period of time T1. When the first switch Q1 is turned off and the second switch Q2 is turned on after the lapse of the first period of time T1, the current applied to the induction heating coil 201 decreases from positive to negative.

Furthermore, as shown in FIG. 10, when the first switch Q1 is turned on and the second switch Q2 is turned off, the current applied to the induction heating coil 201 (the current flowing in the induction heating coil 201) may increase from negative to positive. The increase of the current applied to the induction heating coil 201 may be larger for a second period of time T2 than for the first period of time T1, and the current applied to the induction heating coil 201 may increase to a second amplitude A2, which is larger than the first amplitude A1. When the first switch Q1 is turned off and the second switch Q2 is turned on after the lapse of the second period of time T2, the current applied to the induction heating coil 201 decreases from positive to negative.

In this way, a sinusoidal AC current is applied to the induction heating coil 201 according to the switching operation of the first and second switches Q1 and Q2. The longer the switching period of the first and second switches Q1 and Q2 is, i.e., the smaller the switching frequency of the first and second switches Q1 and Q2 is, the larger the current to be applied to the induction heating coil 201 is and the larger the intensity of a magnetic field output by the induction heating coil 201 (or the output of the cooking apparatus) is.

The distribution circuit 154 may include a plurality of switches R1, R2, . . . R44 to pass or block the current applied to the plurality of induction heating coils 201, and the plurality of switches R1, R2, . . . , R44 may be turned on or off according to distribution control signals from the driving processor 157.

As shown in FIG. 6, the induction heating coils 201 are connected in parallel between a first node n1 at which the first switch Q1 and the second switch Q2 join and a second node n2 at which the first resonant capacitor C3 and the second resonant capacitor C4 join. The plurality of switches R1, R2, . . . , R44 of the distribution circuit 154 may be connected in series with the plurality of induction heating coils 201, and may pass or block the current applied from the inverter circuit 153 to the induction heating coil 201.

The first driver 150 of the cooking apparatus 100 may apply a driving current to the plurality of induction heating coils 201. For example, the first driver 150 may apply a driving current to the induction heating coils 201, e.g., 44 induction heating coils as shown in FIG. 2. The cooking apparatus 100 may also determine a position where the cookware 1 is placed, i.e., which induction heating coil overlaps with the cookware 1. Accordingly, for efficient operation, the cooking apparatus 100 may selectively apply a driving current to the induction heating coil overlapping with the cookware 1.

Specifically, when the cookware 1 put on the cooking plate 102 is detected, the cooking apparatus 100 may close (turn on) switches R1, R2, . . . , R44 connected to the induction heating coil overlapping with the cookware 1 while opening (turning off) switches R1, R2, . . . , R44 connected to the induction heating coil not occupied by the cookware 1. The cooking apparatus 1 may further control the inverter circuit 153 to apply a driving current to the induction heating coil overlapping with the cookware 1.

In the case that the first driver 150 drives 44 induction heating coils 201 as shown in FIG. 2, there may be 44 switches R1, R2, . . . , R44 provided to control the current to be applied to each of the 44 induction heating coils 201.

Although FIG. 6 shows the induction heating coils 201 connected in parallel to the first node n1 and the second node n2, how the induction heating coils 201 are connected is not limited thereto. For example, the plurality of induction heating coils 201 may be connected in series to the first node n1 and the second node n2, as shown in FIG. 11.

To have the plurality of induction heating coils 201 connected in series, the distribution circuit 154 may include a plurality of switches R1, R2, . . . , R86 to pass or block the current to be applied to the plurality of induction heating coils 201. The plurality of switches R1, R2, . . . , R86 may be turned on or off according to a distribution control signal from the driving processor 157.

The plurality of switches R1, R2, . . . , R86 of the distribution circuit 154 may be arranged between a plurality of induction heating coils 201-1, 201-2, . . . , 201-44. For example, the first switch R1 may be provided between an end of the first induction heating coil 201-1 and an end of the second induction heating coil 201-2, and the second switch R2 may be provided between the other end of the first induction heating coil 201-1 and the other end of the second induction heating coil 201-2. Furthermore, the third switch R3 may be provided between an end of the second induction heating coil 201-2 and an end of the third induction heating coil 201-3, and the fourth switch R4 may be provided between the other end of the second induction heating coil 201-2 and the other end of the third induction heating coil 201-3.

When the cookware 1 put on the cooking plate 102 is detected, the cooking apparatus 100 may close (turn on) or open (turn off) associated switches R1, R2, . . . , R86 to have induction heating coils overlapping with the cookware 1 connected in series with each other.

For example, when the first and second induction heating coils 201-1 and 201-2 are occupied by the cookware 1 while the third induction heating coil 201-3 is not occupied by the cookware 1, the cooking apparatus 100 may close (turn on) the second, third, and fifth switches R2, R3, and R5. As a result, the first and second induction heating coils 201-1 and 201-2 are selectively connected in series but the third induction heating coil 201-3 is not connected in series with the first or second induction heating coil 201-1 or 201-2. Accordingly, the driving current is not applied to the third induction heating coil 201-3.

In another example, when the second and third induction heating coils 201-2 and 201-3 are occupied by the cookware 2 while the first induction heating coil 201-1 is not occupied by the cookware 1, the cooking apparatus 100 may close (turn on) the first, third, and sixth switches R1, R3, and R6. As a result, the second and third induction heating coils 201-2 and 201-3 are selectively connected in series but the first induction heating coil 201-1 is not connected in series with the second or third induction heating coil 201-2 or 201-3. Accordingly, the driving current is not applied to the first induction heating coil 201-1.

As such, the distribution circuit 154 may block the driving current to the induction heating coil 201 that is not occupied by the cookware 1 while selectively allowing the driving current to be applied to the induction heating coil overlapping with the cookware 1.

The current detection circuit 155 may include a current sensor S1 to measure the current output from the inverter circuit 153. The current sensor S1 may output an electric signal corresponding to the measured current to the driving processor 157.

To control an amount of heat created by the cookware 1 due to the magnetic field of the cooking apparatus 100, the user may control the output of the cooking apparatus 100 through the user interface 120. In this regard, an amount of heat created by the cookware 1 may be controlled based on the intensity of the magnetic field B produced by the induction heating coil 201, and the intensity of the magnetic field B produced by the induction heating coil 201 may be controlled based on the magnitude of the current applied to the induction heating coil 201. Accordingly, the cooking apparatus 100 may control the magnitude of the current to be applied to the induction heating coil 201 to control an amount of heat created by the cookware 1, and may measure the magnitude of the current applied to the induction heating coil 201, i.e., the magnitude of the current output from the inverter circuit 153, to control the magnitude of the current to be applied to the induction heating coil 201.

The current sensor S1 may include various circuits. For example, the current sensor S1 may include a hall sensor to measure the intensity of a magnetic field produced around an electric wire applying a current to the induction heating coil 201, and may calculate the magnitude of the current output from the inverter circuit 153 based on the intensity of the magnetic field measured by the hall sensor.

The driving memory 156 may store a driving program and driving data for controlling the operation of the first driver 150. Furthermore, the driving memory 156 may temporarily store control instructions received from the controller 110 and current values measured by the current detection circuit 155.

The driving memory 156 may include a volatile memory, such as a static random access memory (SRAM), a dynamic RAM (DRAM), or the like, which may temporarily store data. The driving memory 156 may also include a non-volatile memory, such as a Read Only Memory (ROM), an Erasable Programmable ROM (EPROM), an Electrically Erasable Programmable ROM (EEPROM), flash memory, or the like, which may permanently store the driving control program and/or driving control data.

The driving processor 157 may include various logic circuits and operation circuits, and process data under a program provided from the driving memory 156 and generate a control signal based on the result of the process.

For example, the driving processor 157 may calculate a switching frequency (turn-on/turn-off frequency) for the switching circuit 153*a* of the inverter circuit 153 from an output control signal indicating output intensity of the cooking apparatus 100, and generate a driving control signal to turn on/turn off the switching circuit 153*a* based on the calculated switching frequency. Furthermore, the driving processor 157 may generate distribution control signals to turn on or off the plurality of switches R1, R2, . . . , R44 of the distribution circuit 154 depending on the position information of the cookware 1 received from the controller 110.

The driving memory 156 and the driving processor 157 may be implemented in separate ICs or implemented integrally in a single IC.

Furthermore, the first and second drivers 150 and 160 may share the driving memory 156 and the driving processor 157. In other words, operations of the first and second drivers 150 and 160 may be controlled by a single driving memory 156 and a single driving processor 157.

As such, the first driver 150 may selectively apply the driving current to the plurality of induction heating coils 201 based on the output intensity output from the controller 110.

The controller 110 may control general operation of the cooking apparatus 100 according to user inputs received through the user interface 120, and include a main memory 111 and a main processor 112.

The main memory 111 may store a control program and control data for controlling the operation of the cooking apparatus 100. Furthermore, the main memory 111 may temporarily store user inputs received through the user interface 120, position data of the cookware 1 received from the cookware detector 130, and temperature data of the cookware 1 received from the temperature detector 140.

The main memory 111 may also provide a control program/control data to the main processor 112 according to a memory control signal from the main processor 112 or provide the user input, the position data of the cookware 1 and/or the temperature data of the cookware 1 to the main processor 112.

The main memory 111 may include volatile memories, such as S-RAMs, D-RAMs, or the like, to temporarily store data. Furthermore, the main memory 111 may include non-volatile memories, such as ROMs, EPROMs, EEPROMs, flash memories, etc., to permanently store the control program and/or control data.

The main processor 112 may include various logic circuits and operation circuits, and process data under a program provided from the main memory 111 and generate a control signal according to the result of the process.

For example, the main processor 112 may generate output control signals to control the intensity of the magnetic field B of the induction heating coil 201 based on the output intensity selected through the user interface 120. Moreover, the main processor 112 may generate an anti-overheating signal to cut off the AC power supplied to the first driver 150 depending on the temperature of the cookware 1. The main processor 112 may also generate distribution control signals to turn on or off the plurality of switches R1, R2, . . . , R44 of the distribution circuit 154 depending on the position of the cookware 1.

The main memory 111 and the main processor 112 may be implemented in separate ICs or implemented integrally in a single IC.

In this way, the controller 110 may control the first driver 150 to selectively apply the driving current to the plurality of induction coils 201 according to the user input received through the user interface 120.

Operation of the cooking apparatus 100 will now be described.

The operation of the cooking apparatus 100 will be performed by the program stored in the main memory 111 of the controller 110 and/or the driving memory 156 of the first and second drivers 150 and 160, which is carried out by the main processor 112 and/or the driving processor 157. In the following description, it is assumed that the operation of the cooking apparatus 100 is performed by controlling and/or driving of the controller 110 and/or the first and second drivers 150 and 160. Alternatively, in the following description, it is assumed that the operation of the cooking apparatus 100 is performed by carrying out the program stored in the controller 110 and/or the first and second drivers 150 and 160.

Figure 12:
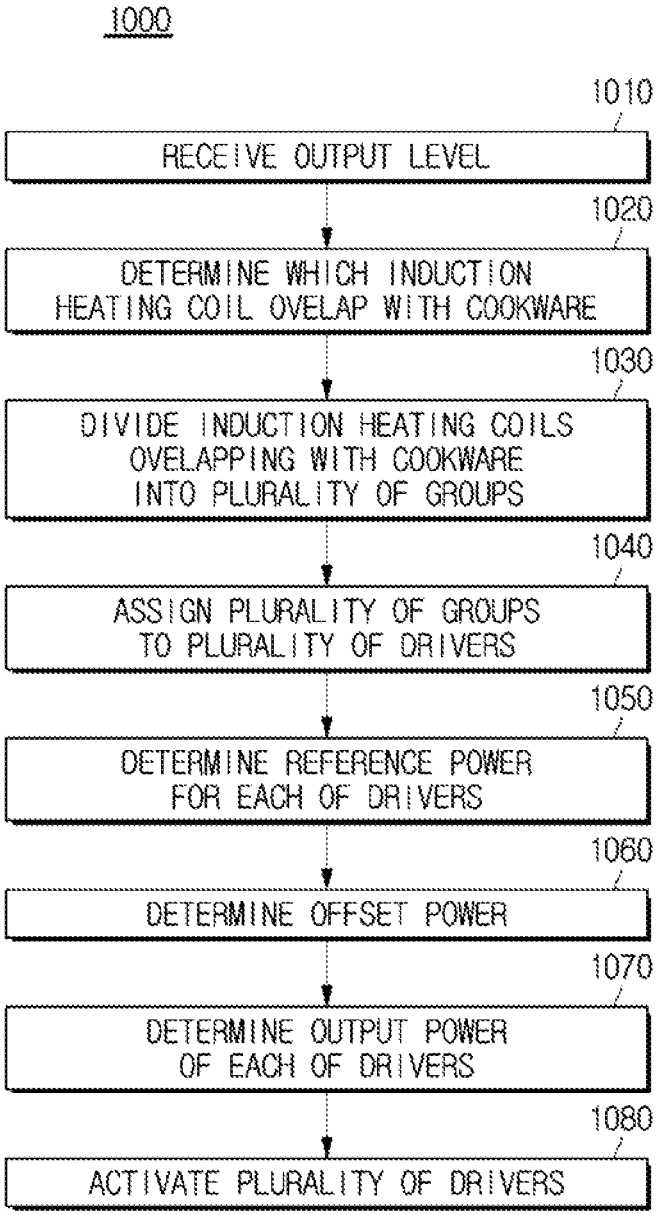
FIG. 12 is a flowchart illustrating a heating method in a cooking apparatus, according to an embodiment of the present disclosure.
Figure 13:
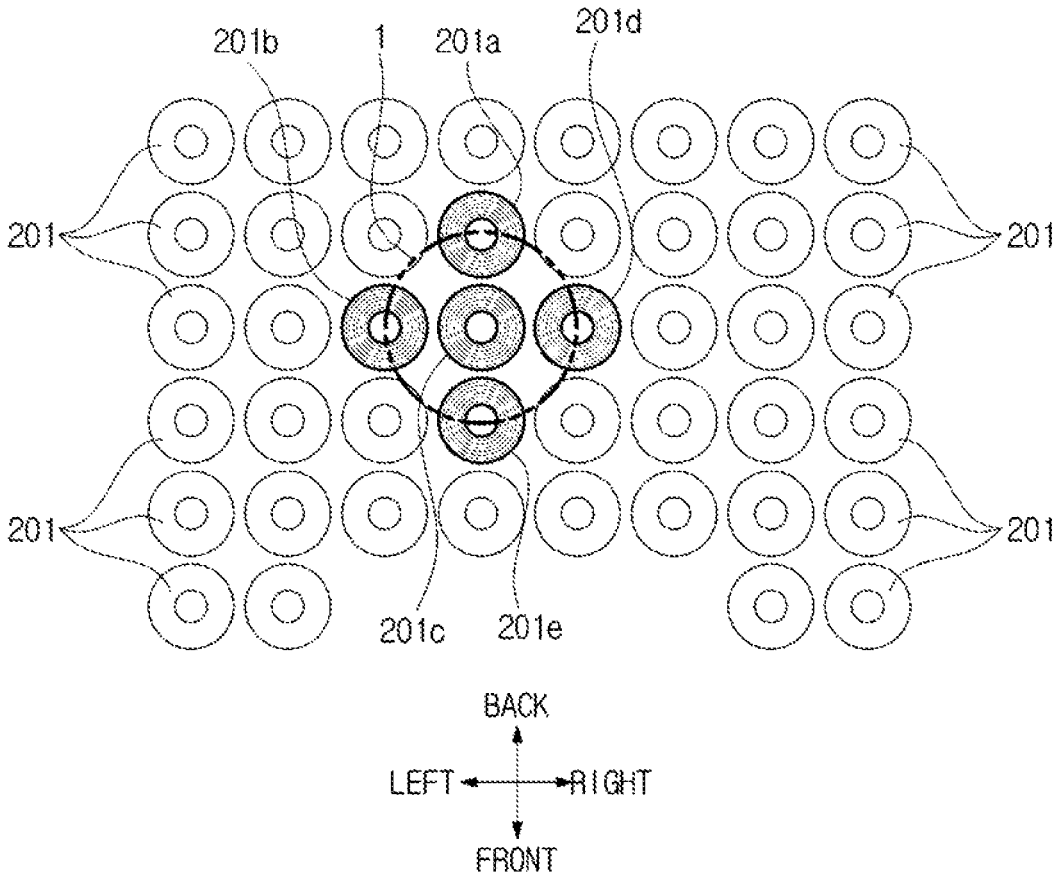
FIG. 13 shows placement of the cookware put on a cooking apparatus, according to an embodiment of the present disclosure.
Figure 14:
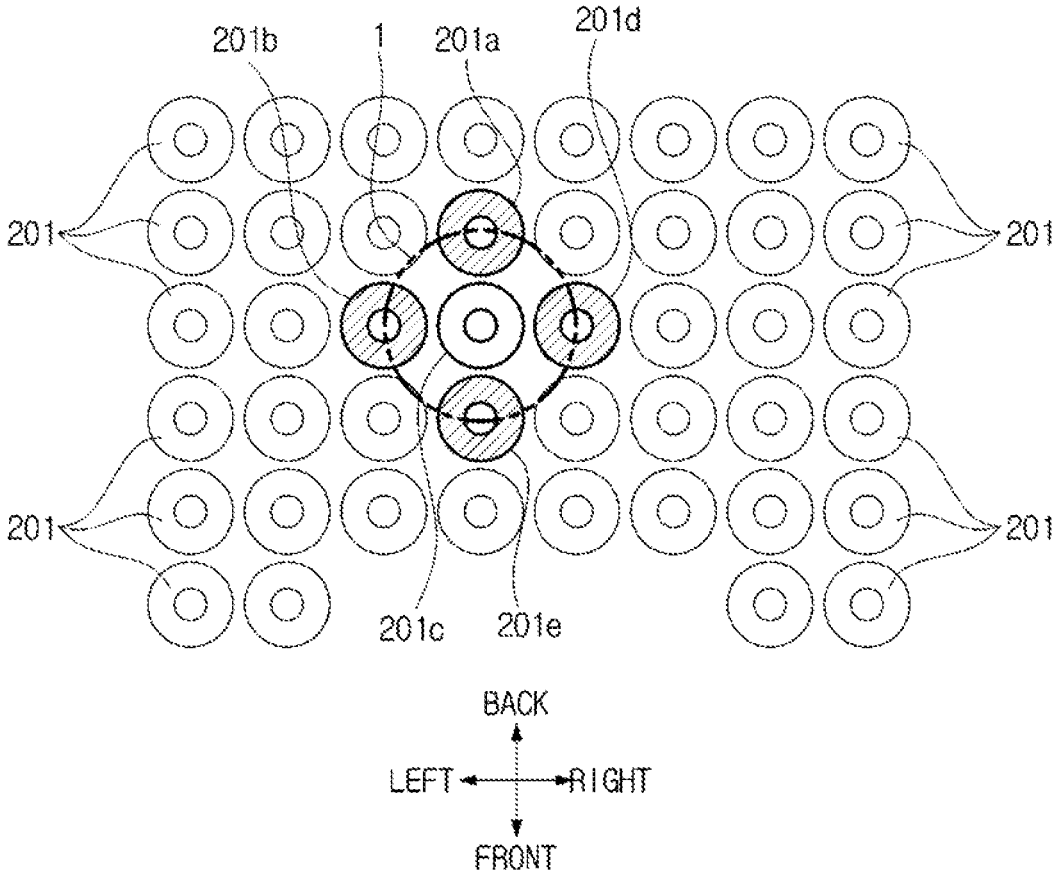
FIG. 14 shows an example of dividing induction heating coils overlapping with the cookware of FIG. 13 into a plurality of groups.
Figure 15:
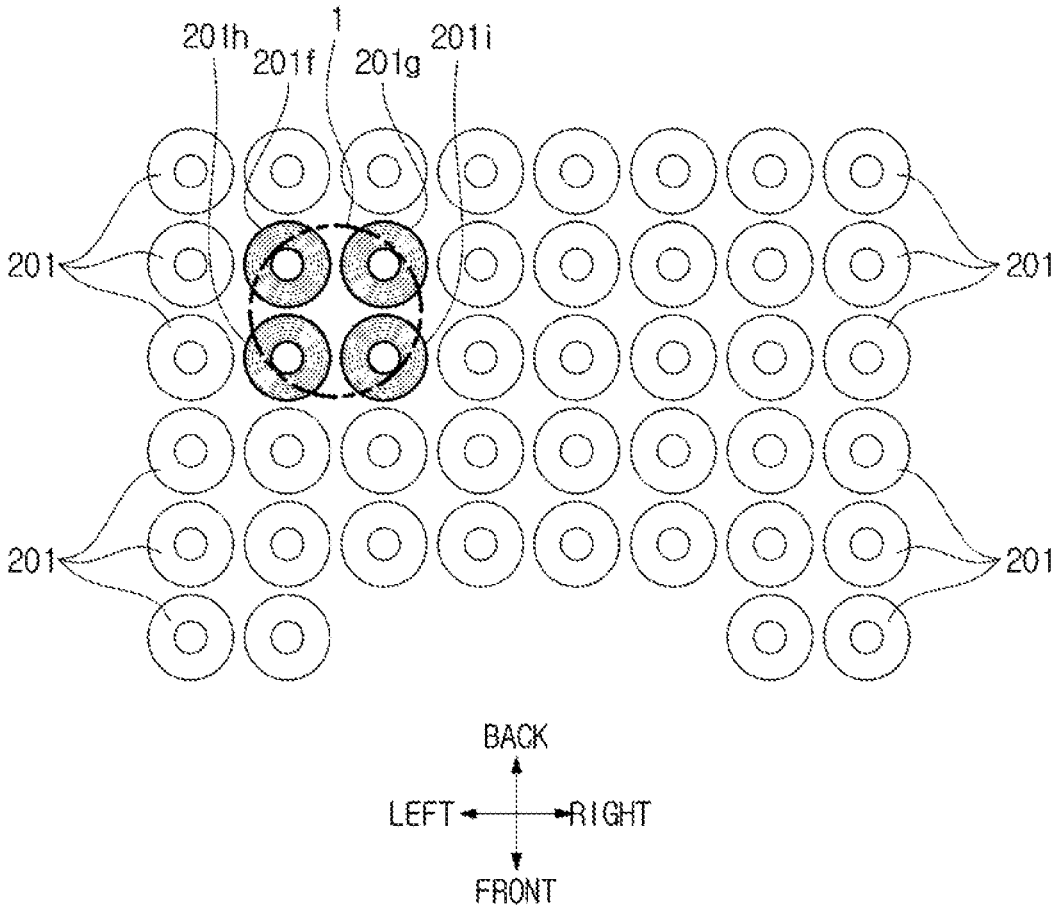
FIG. 15 shows placement of the cookware put on a cooking apparatus, according to another embodiment of the present disclosure.
Figure 16:
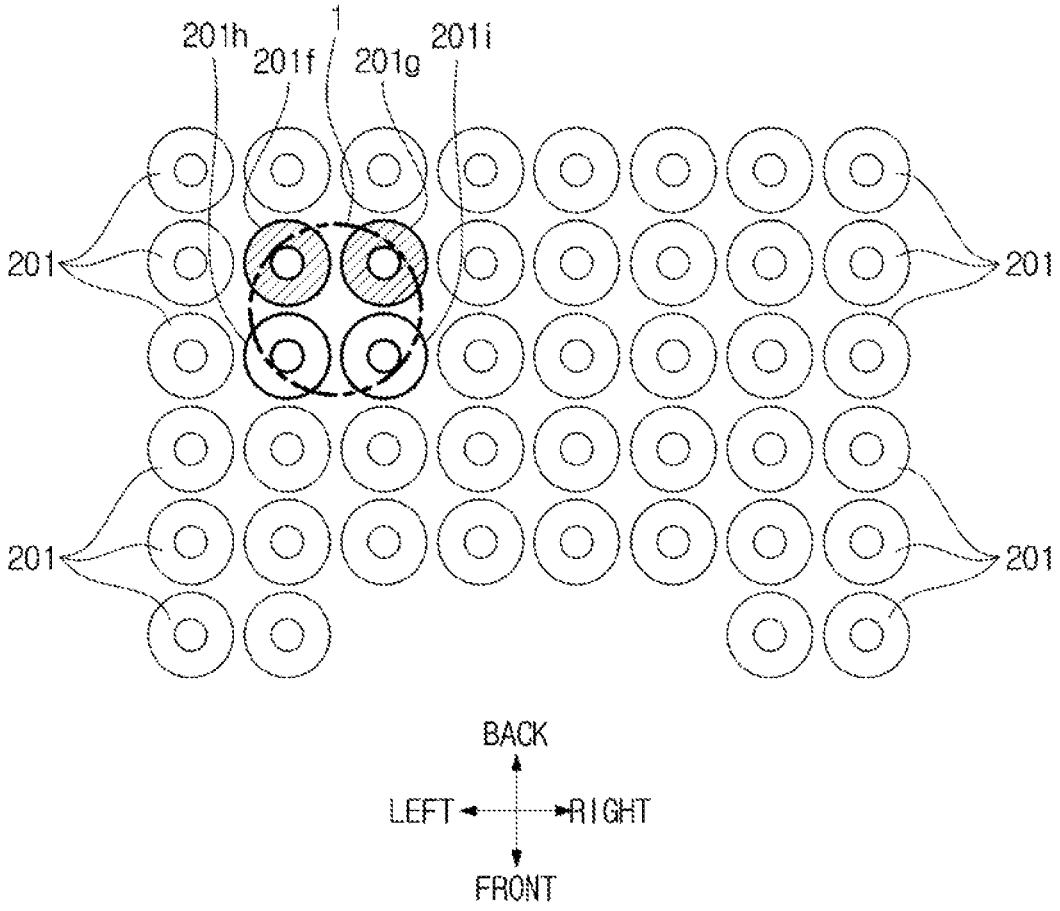
FIGS. 16, 17, and 18 show an example of dividing induction heating coils overlapping with the cookware of FIG. 15 into a plurality of groups.
Figure 17:
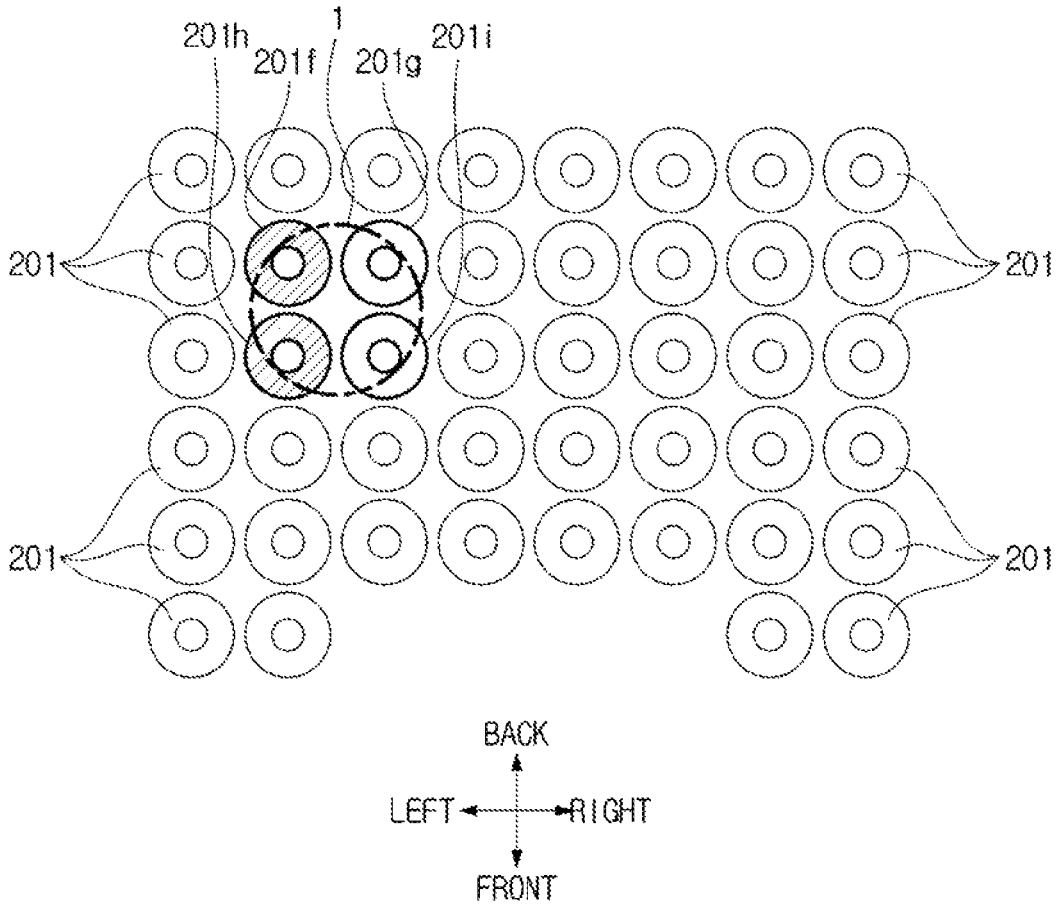
Figure 18:
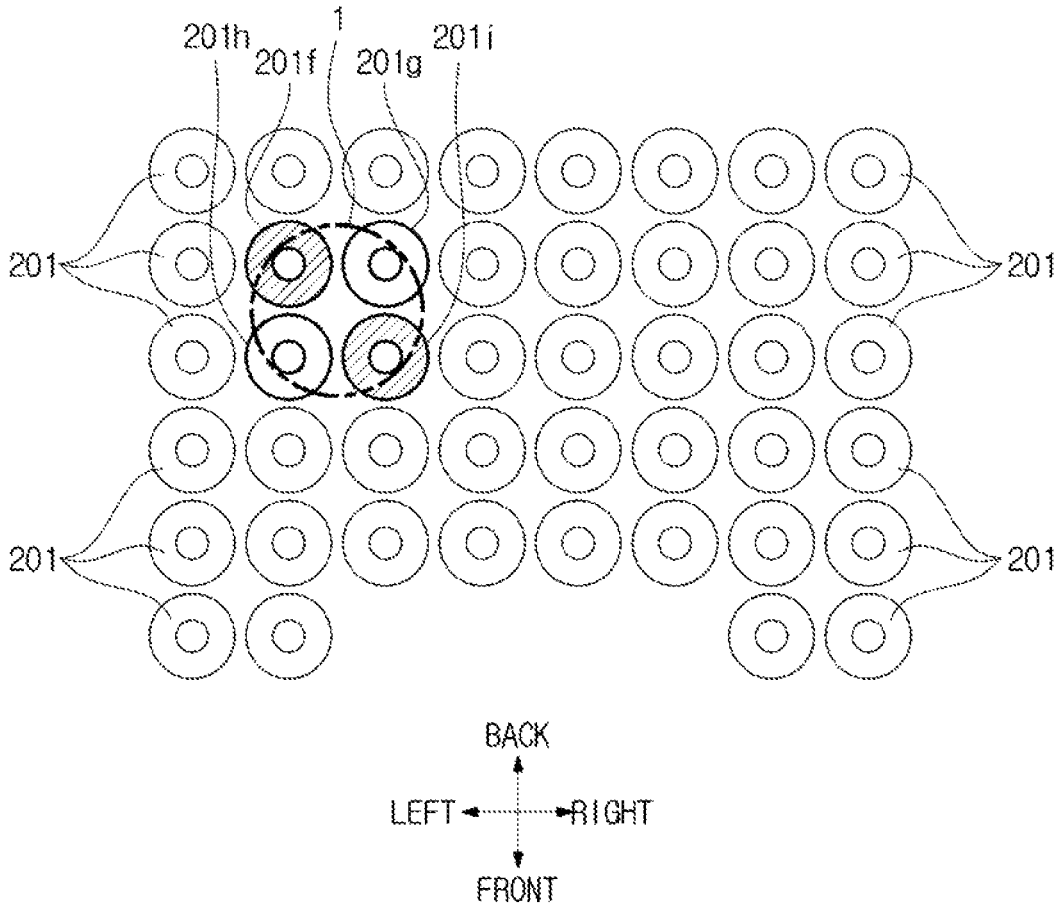
Figure 19:
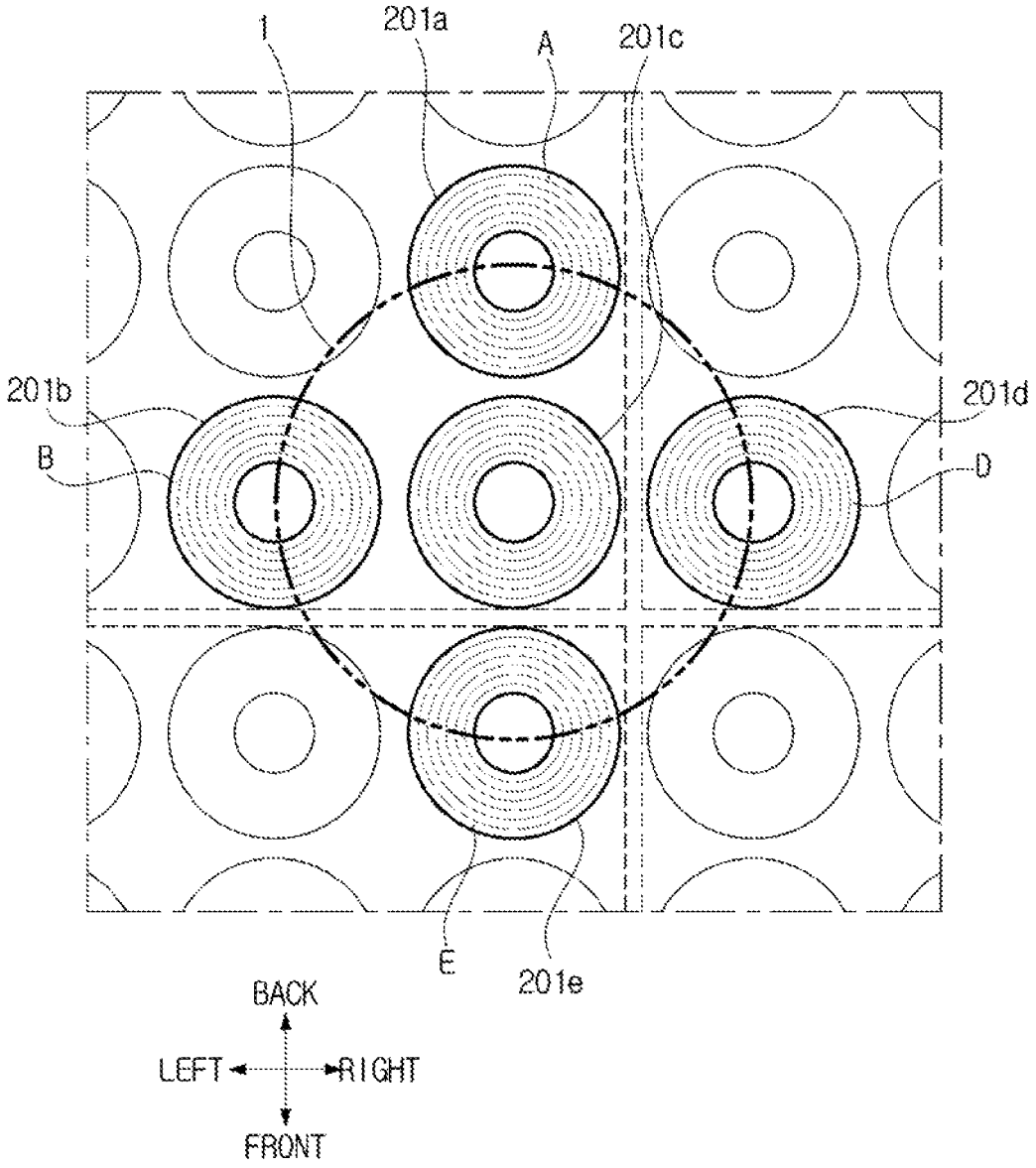
FIG. 19 is an enlarged view of induction heating coils overlapping with the cookware of FIG. 13.
Figure 20:
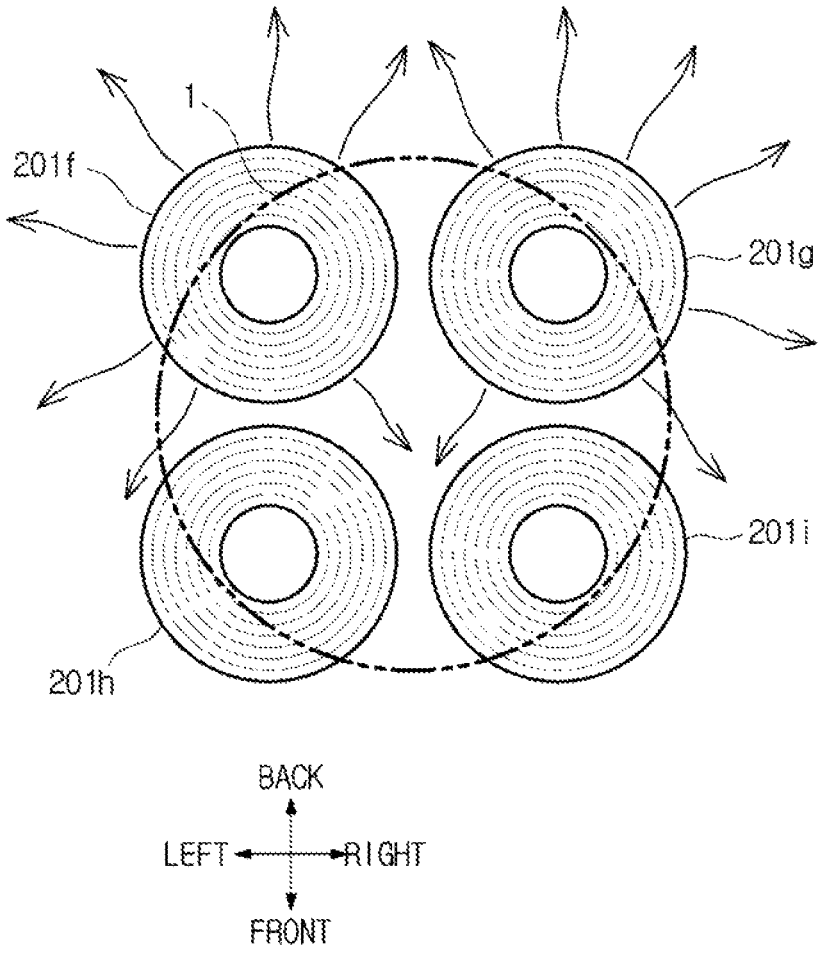
FIG. 20 is an enlarged view of induction heating coils overlapping with the cookware of FIG. 18.

FIG. 12 is a flowchart illustrating a heating method in a cooking apparatus, according to an embodiment of the present disclosure. FIG. 13 shows placement of the cookware put on a cooking apparatus, according to an embodiment of the present disclosure. FIG. 14 shows an example of dividing induction heating coils overlapping with the cookware of FIG. 13 into a plurality of groups. FIG. 15 shows placement of the cookware put on a cooking apparatus, according to another embodiment of the present disclosure. FIGS. 16, 17, and 18 show an example of dividing induction heating coils overlapping with the cookware of FIG. 15 into a plurality of groups. FIG. 19 is an enlarged view of induction heating coils overlapping with the cookware of FIG. 13. FIG. 20 is an enlarged view of induction heating coils overlapping with the cookware of FIG. 18.

A heating method 1000 in the cooking apparatus 100 will be described in connection with FIGS. 12 to 20.

The cooking apparatus 100 receives information or a command about an output level from the user, in 1010.

The user interface 120 may display output levels to be selected by the user, e.g., "Level 1", "Level 2", . . . , "Level N", or may have buttons to increase the output level (power up button) and decrease the output level (power down button).

The user may input an output level to the cooking apparatus 100 through the user interface 120. The output level may represent the intensity of a magnetic field produced by the induction heating coil 201 (or output power of the cooking apparatus 100). The output level input by the user may not be an absolute value of output power of the cooking apparatus 100 but may be a relative value that represents the output power of the cooking apparatus 100. For example, "Level 2" may represent that the output power of the cooking apparatus 100 is higher than that of "Level 1".

The user interface 120 may output an electric signal corresponding to the output level input by the user to the controller 110.

The controller 110 of the cooking apparatus 100 may determine the intensity of a magnetic field produced by the induction heating coil 201 based on the output level input by the user. The main memory 111 of the controller 110 may store a lookup table having output levels to be selected or input by the user and corresponding output power of the cooking apparatus 100.

The controller 110 may use the lookup table to determine the output power of the cooking apparatus 100 corresponding to an output level input by the user. For example, the controller 110 may control the first driver 150 to output a magnetic field corresponding to 100 Watt (W) of power in response to the input "Level 1", and to output a magnetic field corresponding to 200 W of power in response to the input "Level 2".

The cooking apparatus 100 determines which induction heating coil 201 overlaps with the cookware 1, in 1020.

The cookware 1 may be placed anywhere on the cooking plate 102. For efficient operation, the cooking apparatus 100 may determine a position of the cookware 1 on the cooking plate 102 or the induction heating coil 201 overlapping with the cookware 1, and selectively activate the induction heating coil 201 overlapping with the cookware 1.

For example, the cooking apparatus 100 may use the cookware detector 130 to determine which induction heating coil 201 overlaps with the cookware 1. The cookware detector 130 may include a plurality of cookware sensors 131 installed respectively in the induction heating coils 201.

The plurality of cookware sensors 131 may detect the cookware 1, and in response to the detection of the cookware 1, output a cookware detection signal to the controller 110. For example, as shown in FIG. 13, the cookware 1 may be placed on a location overlapping first, second, third, fourth, and fifth induction heating coils 201*a*, 201*b*, 201*c*, 201*d*, and 201*e*. The cookware sensors 131 installed respectively in the first to fifth induction heating coils 201*a*, 201*b*, 201*c*, 201*d*, and 201*e* may detect the cookware 1 and output the cookware detection signal to the controller 110.

The controller 110 may determine the position of the cookware 1 or which induction heating coil 201 overlaps with the cookware 1 based on the cookware detection signal input from the plurality of cookware sensors 131. For example, the controller 110 may determine that the first to fifth induction heating coils 201*a*, 201*b*, 201*c*, 201*d*, and 201*e* overlap with the cookware 1 based on the cookware detection signals of the cookware sensors 131 installed in the first to fifth induction heating coils 201*a*, 201*b*, 201*c*, 201*d*, and 201*e*.

In another example, the cooking apparatus 100 may determine which induction heating coil 201 overlaps with the cookware 1 based on a change in inductance of the induction heating coils 201 due to approaching of the cookware 1.

The cooking apparatus 100 may output detection signals to the plurality of induction heating coils 201 at regular intervals and measure currents flowing in the plurality of induction heating coils 201 due to the detection signals. Furthermore, the cooking apparatus 100 may compare the measured current magnitude and the reference current magnitude to determine which induction heating coil 201 overlaps with the cookware 1. Specifically, if the measured current magnitude is smaller than the reference current magnitude, the cooking apparatus 100 may determine that the induction heating coil 201 overlaps with the cookware 1.

The cooking apparatus 100 divides the induction heating coils 201 overlapping with the cookware 1 into a plurality of groups, in 1030.

The cooking apparatus 100 having the plurality of drivers 150 and 160 may properly assign the plurality of induction heating coils 201 to the drivers 150 and 160. Each of the drivers 150 and 160 may apply a driving current to the induction heating coils 201 assigned thereto.

The controller 110 of the cooking apparatus 100 may divide the induction heating coils 201 overlapping with the cookware 1 into a plurality of groups to assign the induction heating coils 201 overlapping with the cookware 1 to the plurality of drivers 150 and 160. The controller 110 may divide the induction heating coils 201 overlapping with the cookware 1 into the same number of groups as the number of drivers 150 and 160. For example, in the case of the cooking apparatus 100 having the first and second drivers 150 and 160, the controller 110 may divide the induction heating coils 201 overlapping with the cookware 1 into two groups.

However, the controller 110 may divide the induction heating coils 201 overlapping with the cookware 1 into groups in many different ways.

For example, the controller 110 may divide the induction heating coils 201 overlapping with the cookware 1 into a plurality of groups by the relative position of the induction heating coils 201 overlapping with the cookware 1. The controller 110 may classify the induction heating coils 201 into inner and outer induction heating coils 201.

As shown in FIG. 14, the first to fifth induction heating coils 201*a*, 201*b*, 201*c*, 201*d*, and 201*e* may be occupied by the cookware 1. Of the first to fifth induction heating coils 201*a*, 201*b*, 201*c*, 201*d*, and 201*e*, the third induction heating coil 201*c* is surrounded by the first, second, fourth, and fifth induction heating coils 201*a*, 201*b*, 201*d*, and 201*e*. In other words, the third induction heating coil 201*c* and the neighboring four induction heating coils 201*a*, 201*b*, 201*d*, and 201*e* overlap with the cookware 1. The controller 110 may classify the third induction heating coil 201*c* into the first group having inner induction heating coils.

On the contrary, the first, second, fourth, and fifth induction heating coils 201*a*, 201*b*, 201*d*, and 201*e* are located on the outside of the third induction heating coil 201*c*. Furthermore, at least one of induction heating coils adjacent to each of the first, second, fourth, and fifth induction heating coils 201*a*, 201*b*, 201*d*, and 201*e* is not occupied by the cookware 1. The controller 110 may classify the first, second, fourth, and fifth induction heating coils 201*a*, 201*b*, 201*d*, and 201*e* into the second group having outer induction heating coils.

As described above, the controller 110 may divide the induction heating coils 201 overlapping with the cookware 1 into inner and outer induction heating coils by the relative position of the induction heating coils 201.

How to divide the induction heating coils 201 overlapping with the cookware 1 into groups is not, however, limited thereto.

For example, as shown in FIG. 15, the cookware 1 may be placed on a location overlapping sixth, seventh, eighth, and ninth induction heating coils 201*f*, 201*g*, 201*h*, and 201*i*. At least one of induction heating coils adjacent to each of the sixth, seventh, eighth, and ninth induction heating coils 201*f*, 201*g*, 201*h*, and 201*i* is not occupied by the cookware 6. Accordingly, the sixth, seventh, eighth, and ninth induction heating coils 201*f*, 201*g*, 201*h*, and 201*i* may all correspond to outer induction heating coils.

With this placement of the cookware 1 as shown in FIG. 15, it is not appropriate to divide the induction heating coils 201*f*, 201*g*, 201*h*, and 201*i* into inner and outer groups of induction heating coils.

In this case, the controller 110 may divide the induction heating coils 201*f*, 201*g*, 201*h*, and 201*i* into groups in another method different from what is described above in connection with FIG. 14.

For example, the controller 110 may divide the induction heating coils 201*f*, 201*g*, 201*h*, and 201*i* overlapping with the cookware 1 into front and back or left or right groups based on the positions of the induction heating coils 201*f*, 201*g*, 201*h*, and 201*i* overlapping with the cookware 1.

In the case that the sixth, seventh, eighth, and ninth induction heating coils 201*f*, 201*g*, 201*h*, and 201*i* overlap with the cookware 1 as shown in FIG. 15, the controller 110 may classify the sixth and seventh induction heating coils 201*f* and 201*g* located in the rear direction of the cooking apparatus 100 into the first group and the eighth and ninth induction heating coils 201*h* and 201*i* located in the front direction of the cooking apparatus 100 into the second group as shown in FIG. 16.

In another example, the controller 110 may divide the induction heating coils 201*f*, 201*g*, 201*h*, and 201*i* overlapping with the cookware 1 based on the arrangement sequence of the induction heating coils 201*f*, 201*g*, 201*h*, and 201*i*. Specifically, the controller 110 may classify the induction heating coils 201*f*, 201*g*, 201*h*, and 201*i* alternately into the first and second groups based on the arrangement sequence of the induction heating coils 201*f*, 201*g*, 201*h*, and 201*i*.

In the case that the sixth, seventh, eighth, and ninth induction heating coils 201*f*, 201*g*, 201*h*, and 201*i* overlap with the cookware 1 as shown in FIG. 15, the controller 110 may classify the sixth induction heating coil 201*f* located on the rearmost and leftmost side among the sixth to ninth induction heating coils 201*f*, 201*g*, 201*h*, and 201*i* into the first group and the seventh induction heating coil 201*g* located on the right side of the sixth induction heating coil 201*f* into the second group, as shown in FIG. 17. Furthermore, the controller 110 may classify the eighth induction heating coil 201*h* located in front of the sixth induction heating coil 201*f* into the first group and the ninth induction heating coil 201*i* located on the right side of the eighth induction heating coil 201*h* into the second group.

In another example, the controller 110 may classify the induction heating coils 201*f*, 201*g*, 201*h*, and 201*i* overlapping with the cookware 1 such that neighboring induction heating coils may not belong to the same group. In other words, the controller 110 may classify the neighboring induction heating coils into different groups.

In the case that the sixth, seventh, eighth, and ninth induction heating coils 201*f*, 201*g*, 201*h*, and 201*i* overlap with the cookware 1 as shown in FIG. 15, the controller 110 may classify the sixth induction heating coil 201*f* located on the rearmost and leftmost side among the sixth to ninth induction heating coils 201*f*, 201*g*, 201*h*, and 201*i* into the first group as shown in FIG. 18. The controller 110 may classify the seventh and eighth induction heating coil 201*g* and 201*h* adjacent to the sixth induction heating coil 201*f* into the second group. Furthermore, the controller 110 may classify the ninth induction heating coil 201*i* adjacent to the seventh and eighth induction heating coils 201*g* and 201*h* into the first group.

As described above, the induction heating coils overlapping with the cookware 1 may be divided into groups (e.g., two groups) in various ways.

The aforementioned method of dividing the induction heating coils 201 into groups is only by way of example and is not limited thereto. The induction heating coils 201 may be divided into groups in other ways that are not described above.

The cooking apparatus 100 assigns the groups of the induction heating coils 201 overlapping with the cookware 1 to the plurality of drivers 150 and 160, in 1040.

The cooking apparatus 100 having the plurality of drivers 150 and 160 may properly assign the plurality of induction heating coils 201 to the drivers 150 and 160. Each of the drivers 150 and 160 may apply a driving current to the induction heating coils 201 assigned thereto. In this regard, the number of the groups of the induction heating coils 201 may be the same as the number of the plurality of drivers 150 and 160.

For example, in the case of the cooking apparatus 100 having the first and second drivers 150 and 160, the controller 110 may divide the induction heating coils 201 overlapping with the cookware 1 into first and second groups. Furthermore, the controller 110 may assign the first and second groups to the first and second drivers 150 and 160, respectively.

As a result, the drivers 150 and 160 may apply driving currents to the induction heating coils 201 belonging to the separate groups.

For example, in the case that the first group has the third induction heating coil 201*c* and the second group has the first, second, fourth, and fifth induction heating coils 201*a*, 201*b*, 201*d*, and 201*e* as shown in FIG. 14, the first driver 150 may apply a driving current to the third induction heating coil 201*c* and the second driver 160 may apply a driving current to the first, second, fourth, and fifth induction heating coils 201*a*, 201*b*, 201*d*, and 201*e*.

The terms first and second drivers 150 and 160 as herein used are just to distinguish different drivers 150 and 160 without referring to particular drivers.

In another example, in the case that the first group has the sixth and ninth induction heating coils 201*f* and 201*i* and the second group has the seventh and eighth induction heating coils 201*g* and 201*h* as shown in FIG. 18, the first driver 150 may apply a driving current to the sixth and ninth induction heating coils 201*f* and 201*i* and the second driver 160 may apply a driving current to the seventh and eighth induction heating coils 201*g* and 201*h*.

The cooking apparatus 100 determines reference power for each of the plurality of drivers 150 and 160, in 1050.

The reference power for each driver 150 or 160 may be proportional to the output power of the cooking apparatus 100 set by the user and the number of induction heating coils 201 driven by the driver 150 or 160.

As described above, the user may input an output level of the cooking apparatus 100 through the user interface 120, and the cooking apparatus 100 may determine output power corresponding to the output level input by the user. For example, the cooking apparatus 100 may produce a magnetic field corresponding to 100 W power in response to the input "Level 1", and may produce a magnetic field corresponding to 200 W power in response to the input "Level 2".

The output power of the cooking apparatus 100 may be evenly distributed to the induction heating coils 201 overlapping with the cookware 1. For example, if five of the induction heating coils 201 are occupied by the cookware 1 and the output power is set to 100 W, each of the five induction heating coils 201 may output a magnetic field corresponding to 20 W power.

Furthermore, each of the plurality of drivers 150 and 160 may supply power proportional to the number of induction heating coils that the driver 150 or 160 drives. For example, if a single induction heating coil is assigned to the first driver 150 while four induction heating coils are assigned to the second driver 160, the first driver 150 may supply 20 W power to the single induction heating coil and the second driver 160 may supply 80 W power to the four induction heating coils.

In other words, the reference power for each of the plurality of drivers 150 and 160 may be defined by the following equations 1 and 2:

$$\text{Reference Power of First Driver} = \text{Output Power of Cooking Apparatus} \times (\text{the Number of Induction Heating Coils Driven by First Driver}/\text{Total Number of Induction Heating Coils}) \quad (1)$$

$$\text{Reference Power of Second Driver} = \text{Output Power of Cooking Apparatus} \times (\text{the Number of Induction Heating Coils Driven by Second Driver}/\text{Total Number of Induction Heating Coils}) \quad (2)$$

According to the equations (1) and (2), the controller 110 may obtain the reference power for each driver 150 or 160 by a multiplication of the output power of the cooking apparatus 100 and a ratio of the induction heating coils 201 driven by each driver 150 or 160.

The cooking apparatus 100 determines offset power to regulate the output of the plurality of drivers 150 and 160, in 1060.

The reference power for each of the plurality of drivers 150 and 160 may be proportional to the number of induction heating coils driven by the driver 150 or 160, and the induction heating coils 201 may each produce the same intensity of magnetic field.

For more stable operation, the intensity of the magnetic field produced by each of the induction heating coils 201 needs to be regulated. In other words, it is necessary to regulate the power output by the plurality of drivers 150 and 160 to the induction heating coils 201.

For example, in the case that the first group has the third induction heating coil 201*c* and the second group has the first, second, fourth, and fifth induction heating coils 201*a*, 201*b*, 201*d*, and 201*e* as shown in FIG. 19, the first driver 150 may apply a driving current to the third induction heating coil 201*c* and the second driver 160 may apply a driving current to the first, second, fourth, and fifth induction heating coils 201*a*, 201*b*, 201*d*, and 201*e*.

In FIG. 19, the entire third induction heating coil 201*c* overlaps with the cookware 1 while at least some parts of the first, second, fourth, and fifth induction heating coils 201*a*, 201*b*, 201*d*, and 201*e* do not overlap with the cookware 1. For example, part A of the first induction heating coil 201*a*, part B of the second induction heating coil 201*b*, part D of the fourth induction heating coil 201*d*, and part E of the fifth induction heating coil 201*e* do not overlap with the cookware 1.

Accordingly, the inductances of the first, second, fourth, and fifth induction heating coils 201*a*, 201*b*, 201*d*, and 201*e* may be smaller than the inductance of the third induction heating coil 201*c*, so the currents flowing in the first, second, fourth, and fifth induction heating coils 201*a*, 201*b*, 201*d*, and 201*e* may increase in magnitude.

Furthermore, due to the parts A, B, C, and D not overlapping with the cookware 1, some of the magnetic fields produced by the first, second, fourth, and fifth induction heating coils 201*a*, 201*b*, 201*d*, and 201*e* are not used to heat the cookware 1. In other words, some of the power supplied by the first, second, fourth, and fifth induction heating coils 201*a*, 201*b*, 201*d*, and 201*e* become reactive power.

Furthermore, since the second driver 160 supplies not only the active power but also the reactive power to the first, second, fourth, and fifth induction heating coils 201*a*, 201*b*, 201*d*, and 201*e*, the stress on the second driver 160 may increase. This may lead to reduction of the life span of the second driver 160.

To prevent this, the output power of the second driver 160 may be reduced. In addition, to maintain the constant output of the entire cooking apparatus 100, the output power of the first driver 150 may be increased. As a result, the reactive power of the second driver 160 may decrease and the stress on the second driver 160 may also decrease.

In another example, in the case that the first group has the sixth and ninth induction heating coils 201*f* and 201*i* and the second group has the seventh and eighth induction heating coils 201*g* and 201*h* as shown in FIG. 20, the first driver 150 may apply a driving current to the sixth and ninth induction heating coils 201*f* and 201*i* and the second driver 160 may apply a driving current to the seventh and eighth induction heating coils 201*g* and 201*h*.

The number of the induction heating coils 201*f* and 201*i* driven by the first driver 150 is the same as the number of the induction coils 201*g* and 201*h* driven by the second driver 160. Accordingly, the reference power for the first driver 150 may be the same as that of the second driver 160, and the switching frequency of the first driver 150 may be the same as that of the second driver 160. As a result, the same frequency of AC power may be supplied to the sixth and ninth induction heating coils 201*f* and 201*i* and the seventh and eighth induction heating coils 201*g* and 201*h*.

When the AC power is supplied to each of the induction heating coils 201*f*, 201*g*, 201*h*, and 201*i*, noise with a frequency corresponding to the frequency of the AC power may be made. When the same frequency of AC power is supplied to all the induction heating coils 201*f*, 201*g*, 201*h*, and 201*i*, the same frequency of noise may be made by all the induction heating coils 201*f*, 201*g*, 201*h*, and 201*i* so the noise may be amplified.

To prevent this, the output power of the second driver 160 may be reduced by increasing the switching frequency of the second driver 160. In addition, to maintain the constant output of the entire cooking apparatus 100, the output power of the first driver 150 may be increased by reducing the switching frequency of the first driver 150. As a result, different frequencies of AC power may be supplied to the sixth and ninth induction heating coils 201*f* and 201*i* and the seventh and eighth induction heating coils 201*g* and 201*h*, and the noise amplification may be reduced.

In another example, the number of the induction heating coils driven by the first driver 150 may be different from the number of the induction coils driven by the second driver 160. The controller 110 may reduce the output power of a driver that drives a greater number of induction heating coils while increasing the output power of a driver that drives a small number of induction heating coils.

If the number of the induction heating coils driven by the first driver 150 is larger than the number of the induction heating coils driven by the second driver 160, the controller 110 may reduce the power output by the first driver 150 and increase the power output by the second driver 160. Otherwise, if the number of the induction heating coils driven by the second driver 160 is larger than the number of the induction heating coils driven by the first driver 150, the controller 110 may reduce the power output by the second driver 160 and increase the power output by the first driver 150.

In this way, the cooking apparatus 100 may determine the offset power that represents a decreased value of output power of the second driver 160 and an increased value of the output power of the first driver 150. The offset power may be used to reduce the reactive power for the induction heating coils 201 or reduce the noise from the induction heating coils 201.

The controller 110 may determine the offset power in many different ways.

For example, the offset power may be a predefined value. The designer of the cooking apparatus 1 may define a value of the offset power to reduce the reactive power and noise, and the controller 110 may set the value predefined by the designer to the offset power.

In another example, the offset power may be determined based on the output power of the cooking apparatus 100. For example, an increase in the output power of the cooking apparatus 100 may lead to an increase in the offset power, and a decrease in the output power of the cooking apparatus 100 may lead to a decrease in the offset power.

In another example, the offset power may be determined based on the difference between the reference power of the first driver 150 and the reference power of the second driver 160. For example, an increase in the difference between the reference power of the first driver 150 and the reference power of the second driver 160 may lead to an increase in the offset power, and a decrease in the difference between the reference power of the first driver 150 and the reference power of the second driver 160 may lead to a decrease in the offset power.

In another example, the offset power may be set based on the largest reference power among the respective reference power of the drivers 150 and 160. For example, if the reference power of the first driver 150 is greater than the reference power of the second driver 160, the offset power may be determined based on the reference power of the first driver 150. In other words, if the reference power of the first driver 150 increases, the offset power may increase, and if the reference power of the first driver 150 decreases, the offset power may decrease.

The cooking apparatus 100 determines output power of the plurality of drivers 150 and 160, in 1070.

The controller 110 of the cooking apparatus 100 may determine the output power for each of the plurality of drivers 150 and 160 based on the reference power of the plurality of drivers 150 and 160 and the offset power. In other words, the controller 110 may determine the output power of one of the plurality of drivers 150 and 160 to be a sum of the reference power and the offset power, and determine the output power of the other one of the drivers 150 and 160 to be a difference between the reference power and the offset power.

For example, in a case that the first driver 150 drives the first group having inner induction heating coils and the second driver 160 drives the second group having outer induction heating coils, the controller 110 may set the output power of the first driver 150 to a sum of the reference power and the offset power and set the output power of the second driver 160 to a difference between the reference power and the offset power.

Specifically, the respective output power of the first and second drivers 150 and 160 may be determined according to the following equations 3 and 4:

$$\text{Output Power of First Driver} = \text{Reference Power of First Driver} + \text{Offset Power} \quad (3)$$

$$\text{Output Power of Second Driver} = \text{Reference Power of Second Driver} - \text{Offset Power} \quad (4)$$

According to the equations (3) and (4), a sum of the output power of the first driver 150 and the output power of the second driver 160 corresponds to the output power of the cooking apparatus 100, which is defined by the user.

If the reference power of the first driver 150 and the reference power of the second driver 160 are the same, the controller 110 may determine the output power of one of the first and second drivers 150 and 160 to be a sum of the reference power and the offset power and determine the output power of the other one of the first and second drivers 150 and 160 to be a difference between the reference power and the offset power.

If the reference power of the first driver 150 is lower than the reference power of the second driver 160, the controller 110 may determine the output power of the first driver 150 to be a sum of the reference power and the offset power and determine the output power of the second driver 160 to be a difference between the reference power and the offset power.

If the reference power of the first driver 150 is higher than the reference power of the second driver 160, the controller 110 may determine the output power of the first driver 150 to be a difference between the reference power and the offset power and determine the output power of the second driver 160 to be a sum of the reference power and the offset power.

In this way, the respective output power of the plurality of drivers 150 and 160 may be determined to be a sum of or a difference between the reference power and the offset power. As a result, the output power of each of the plurality of drivers 150 and 160 may not be proportional to the number of induction heating coils 201 driven by the driver 150 or 160.

The cooking apparatus 100 activates the plurality of drivers 150 and 160, in 1080.

The controller 110 of the cooking apparatus 100 may output values of the output power to the plurality of drivers 150 and 160. In response to the value of the output power output from the controller 110, the driver 150 or 160 may determine a switching frequency of the inverter circuit 153 from the output power and turn on and off the inverter circuit 153 according to the determined switching frequency.

In another example, the controller 110 of the cooking apparatus 100 may determine switching frequencies of the plurality of drivers 150 and 160 from the respective output power for the plurality of drivers 150 and 160, and output the switching frequencies to the plurality of drivers 150 and 160. The drivers 150 and 160 may turn on and off the inverter circuit 153 according to the input switching frequencies.

In response to the turning on and off of the inverter circuit 153, AC currents may be applied to the induction heating coils 201, which may in turn, produce AC magnetic fields alternating in magnitude and direction over time. Due to the AC magnetic fields, the cookware 1 is heated.

As described above, the cooking apparatus 100 may divide the induction heating coils overlapping with the cookware 1 into a plurality of groups and assign the plurality of groups respectively to the plurality of drivers 150 and 160. The cooking apparatus 100 may also determine output power for each of the plurality of drivers 150 and 160 based on the reference power and the offset power.

The reference power may be proportional to the number of induction heating coils driven by the corresponding driver, and the output power of each of the drivers 150 and 160 may be a sum of or a difference between the reference power and the offset power. Accordingly, the power output by each of the plurality of drivers 150 and 160 to the induction heating coils 201 may not be proportional to the number of the induction heating coils 201 driven by the driver 150 or 160. Furthermore, the respective intensity of magnetic fields produced by the induction heating coils overlapping with the cookware 1 may not be the same.

As a result, the reactive power supplied to the induction heating coils 201 may be reduced and thus, the noise made by the induction heating coils 201 may be reduced.

Figure 21:
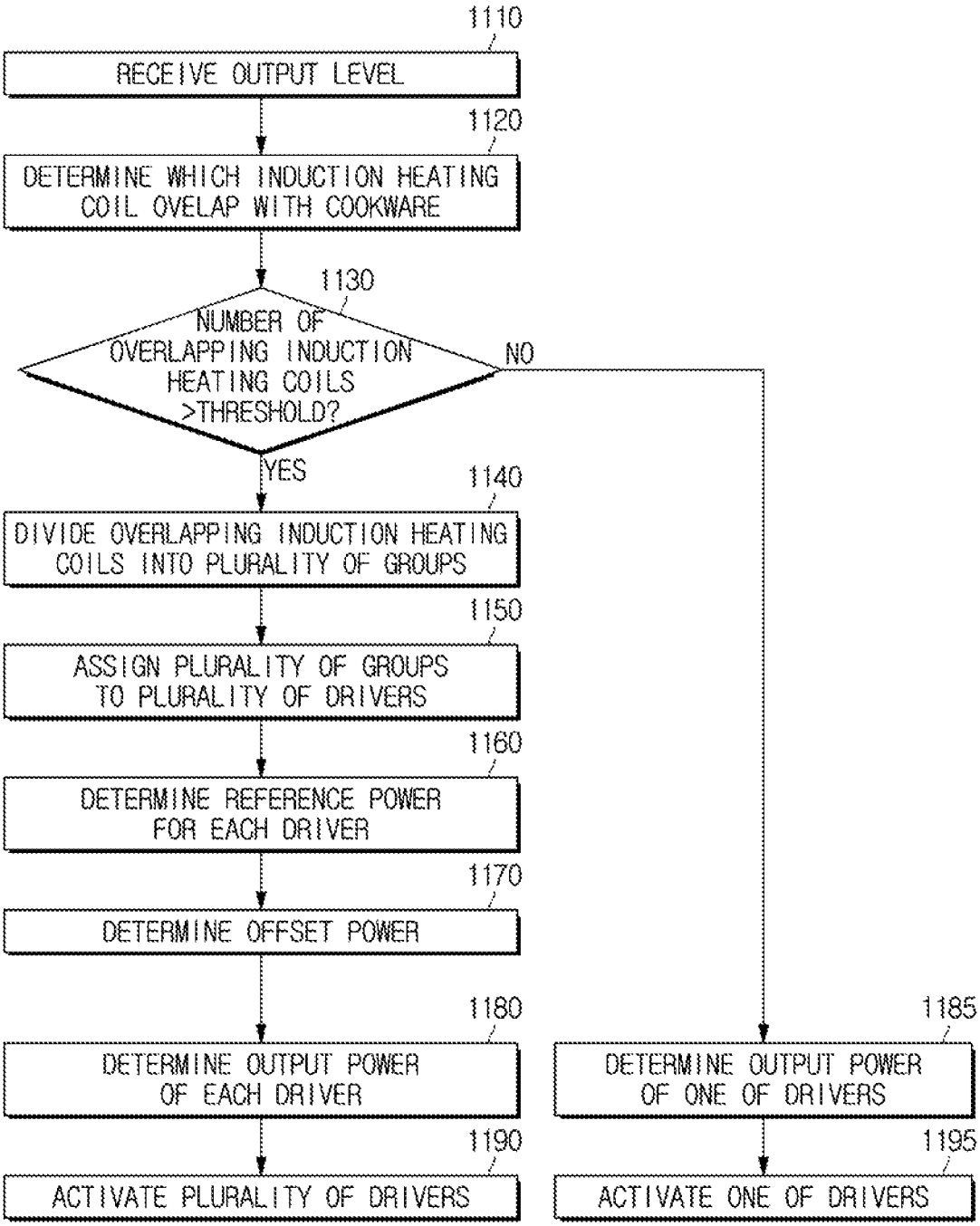
FIG. 21 is a flowchart illustrating a heating method in a cooking apparatus, according to another embodiment of the present disclosure.
Figure 22:
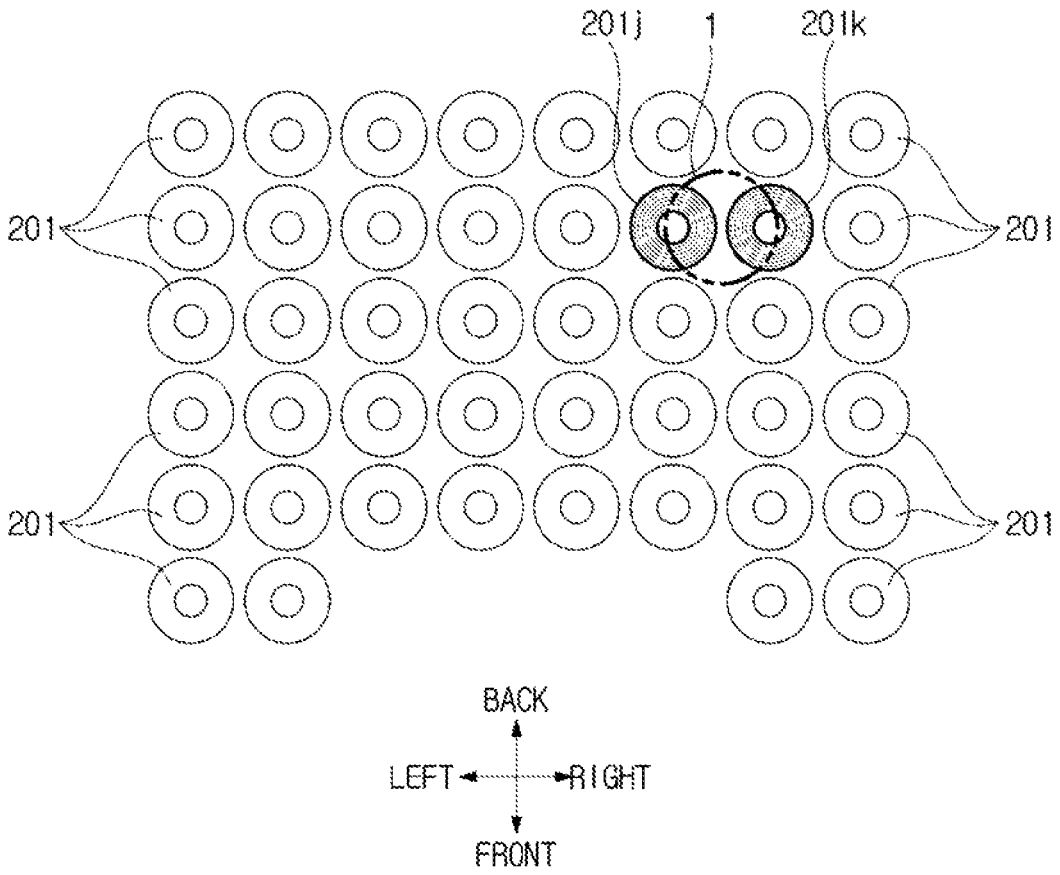
FIG. 22 shows placement of the cookware put on a cooking apparatus, according to another embodiment of the present disclosure.

FIG. 21 is a flowchart illustrating a heating method in a cooking apparatus, according to another embodiment of the present disclosure. FIG. 22 shows placement of the cookware put on a cooking apparatus, according to another embodiment of the present disclosure.

A heating method 1100 in the cooking apparatus 100 will be described in connection with FIGS. 21 and 22.

The cooking apparatus 100 receives information (or a command) about an output level from the user in 1110, and determines which induction heating coil 201 overlaps with the cookware 1 in 1120.

Operations 1110 and 1120 may be the same as the operations 1010 and 1020 of FIG. 12.

The cooking apparatus 100 determines whether the number of the induction heating coils 201 overlapping with the cookware 1 is greater than a threshold, in 1130.

If a small number of induction heating coils, e.g., one or two induction heating coils, overlap with the cookware 1, it may be impossible or inefficient to divide the induction heating coils overlapping with the cookware 1 into a plurality of groups.

For example, if a single induction heating coil overlaps with the cookware 1, it is impossible to divide the single induction heating coil to a plurality of groups.

If two of the induction heating coils overlap with the cookware 2, the induction heating coils overlapping with the cookware 1 may be divided into two groups. In this case, each of the drivers 150 and 160 drives one of the induction heating coil. Considering switching losses of the first and second switches Q1 and Q1 included in each of the drivers 150 and 160, it would be more efficient for one of the drivers 150 and 160 to drive the two induction heating coils than for each of the drivers 150 and 160 to drive one of the induction heating coil.

For more efficient operation, the controller 110 of the cooking apparatus 100 may compare the number of induction heating coils overlapping with the cookware 1 with a threshold to determine whether the number of the induction heating coils overlapping with the cookware 1 is greater than the threshold. The threshold may be e.g., 2 (two).

If the number of the induction heating coils overlapping with the cookware 1 is greater than the threshold in 1130, the cooking apparatus 100 divides the induction heating coils overlapping with the cookware 1 into a plurality of groups in 1140. The cooking apparatus assigns the groups of the induction heating coils 201 overlapping with the cookware 1 to the plurality of drivers 150 and 160 in 1150, determines the reference power for each of the plurality of drivers 150 and 160 in 1160, and determines the offset power for regulating outputs of the plurality of drivers 150 and 160 in 1170. The cooking apparatus 100 determines output power of the plurality of drivers 150 and 160 in 1180 and activates the plurality of drivers 150 and 160 in 1190.

Operations 1140, 1150, 1160, 1170, 1180, and 1190 may be the same as the operations 1030, 1040, 1050, 1060, 1070, and 1080 shown in FIG. 12, respectively.

If the number of the induction heating coils overlapping with the cookware 1 is not greater than the threshold in 1130, the cooking apparatus 100 determines output power of one of the plurality of drivers 150 and 160 in 1185.

The cooking apparatus 100 may select one of the plurality of drivers 150 and 160 to drive the smaller number of induction heating coils than the threshold. For example, the cooking apparatus 100 may select any one of the plurality of drivers 150 and 160 or select a predetermined one of the plurality of drivers 150 and 160. The cooking apparatus 100 determines output power of the selected driver.

Specifically, the cooking apparatus 100 may determine the output power of one of the drivers based on an output level input by the user. For example, the main memory 111 of the controller 110 may store a lookup table having output levels to be selected or input by the user and corresponding output power of the cooking apparatus 100, and the controller 110 may use the lookup table to determine the output power of the cooking apparatus 100 corresponding to an output level input by the user.

The cooking apparatus 100 activates one of the plurality of drivers 150 and 160, in 1195.

The controller 110 of the cooking apparatus 100 may output a value of the output power to the selected one of the plurality of drivers 150 and 160. In response to the value of the output power output from the controller 110, the selected driver may determine a switching frequency of the inverter circuit 153 from the output power and turn on and off the inverter circuit 153 according to the determined switching frequency.

In another example, the controller 110 of the cooking apparatus 100 may determine a switching frequency of the selected driver of the plurality of drivers 150 and 160 from the output power and output the switching frequency to the selected driver. The selected driver may turn on and off the inverter circuit 153 according to the input switching frequency.

In response to the turning on and off of the inverter circuit 153, the AC current may be applied to the induction heating coils 201, which may in turn, produce AC magnetic fields alternating in magnitude and direction over time. Due to the AC magnetic fields, the cookware 1 is heated.

As described above, the cooking apparatus 100 may determine the number of induction heating coils overlapping with the cookware 1, and activate a single driver if the number of the induction heating coils overlapping with the cookware 1 is not greater than the threshold.

As a result, the cooking apparatus 100 may drive the induction heating coils 201 more efficiently.

According to embodiments of the present disclosure, an induction heating cooking apparatus may be provided to include a plurality of induction heating coils.

According to embodiments of the present disclosure, an induction heating cooking apparatus may be provided to include a plurality of driving circuits for driving a plurality of induction heating coils.

According to embodiments of the present disclosure, an induction heating cooking apparatus may be provided to divide a plurality of induction heating coils into a plurality of groups and have each of a plurality of driving circuits drive one of the groups.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A cooking apparatus comprising:

a cooking plate;

a plurality of induction heating coils installed under the cooking plate;

a plurality of drivers configured to supply driving power to the plurality of induction heating coils; and a controller configured to control the plurality of drivers to drive a plurality of groups to which the plurality of induction heating coils belong, respectively, wherein while power output by a first driver, among the plurality of drivers, which drives a first group among the plurality of groups is increased, the controller controls a second driver, among the plurality of drivers, which drives a second group among the plurality of groups to decrease power output by the second driver, wherein a ratio of the power output by the first driver and the power output by the second driver is different from a ratio of a number of induction heating coils belonging to the first group and a number of induction heating coils belonging to the second group.

2. The cooking apparatus of claim 1, further comprising:

a user interface configured to receive information about output of the cooking apparatus from a user, wherein the controller is configured to identify a total power output by all the plurality of drivers based on the information about output of the cooking apparatus.

3. The cooking apparatus of claim 2, wherein the controller is configured to assign the plurality of groups to the plurality of drivers and identify power output by each of the plurality of drivers based on a number of the plurality of induction heating coils belonging to each of the plurality of groups.

4. The cooking apparatus of claim 3, wherein the power output by each of the plurality of drivers is not proportional to the number of the plurality of induction heating coils belonging to the each of the plurality of groups.

5. The cooking apparatus of claim 1, wherein the controller is configured to identify a first offset power value representing a value by which the power output by the first driver is increased to regulate power output by the first driver and a second offset power value representing a value by which the power output by the second driver is decreased to regulate power output by the second driver.

6. The cooking apparatus of claim 5, wherein the controller is configured to identify the first offset power value and the second offset power value based on a total power output by all the plurality of drivers.

7. The cooking apparatus of claim 5, wherein the controller is configured to identify the first offset power value and the second offset power value based on a difference between the power output by the first driver and the power output by the second driver.

8. The cooking apparatus of claim 5, wherein the power output by the first driver is increased and the power output by the second driver is decreased according to the first offset power value and the second offset power value identified for the first driver and the second driver.

9. The cooking apparatus of claim 1, wherein the controller is configured to divide control of the plurality of induction heating coils into the plurality of groups, respectively, and induction heating coils, among the plurality of induction heating coils, are divided into the first group and the second group based on positions of the induction heating coils which overlap with a position of a cookware placed on the cooking plate.

10. The cooking apparatus of claim 9, wherein the first group includes an induction heating coil, an entirety of which overlaps with the position of the cookware and the second group includes an induction heating coil, at least portion of which is outside the position of the cookware.

11. A method of controlling a cooking apparatus having a plurality of induction heating coils installed under a cooking plate, the method comprising:

identifying induction heating coils among the plurality of induction heating coils based on a plurality of groups to which the plurality of induction heating coils belong, respectively;

supplying, by a plurality of drivers, driving power to the plurality of groups of the plurality of induction heating coils, respectively, wherein while power output by a first driver, among the plurality of drivers, driving a first group among the plurality of groups is increased, a second driver, among the plurality of drivers, driving a second group among the plurality of groups is controlled to decrease power output by the second driver, wherein a ratio of the power output by the first driver and the power output by the second driver is different from a ratio of a number of induction heating coils belonging to the first group and a number of induction heating coils belonging to the second group.

12. The method of claim 11, wherein the supplying, by the plurality of drivers, of the driving power to the plurality of groups comprises:

assigning the plurality of groups to the plurality of drivers, respectively; and identifying power output by each of the plurality of drivers based on a number of the plurality of induction heating coils belonging to each of the plurality of groups, and wherein the power output by each of the plurality of drivers disproportional to the number of the plurality of induction heating coils belonging to the each of the plurality of groups.

13. The method of claim 11, further comprising:

identifying a first offset power value representing a value by which the power output by the first driver is increased to regulate power output by the first driver and a second offset power value representing a value by which the power output by the second driver is decreased to regulate power output by the second driver.

14. The method of claim 13, wherein the identifying of the offset power comprises identifying the first offset power value and the second offset power value based on a total power output by all the plurality of drivers.

15. The method of claim 13, wherein the first offset power value and the second offset power value are identified based on a difference between the power output by the first driver and the power output by the second driver.

16. The method of claim 13, further comprising:

increasing the power output by the first driver and decreasing the power output by the second driver according to the first offset power value and the second offset power value identified for the first driver and the second driver.

17. The method of claim 11, wherein induction heating coils among the plurality of induction heating coils, are divided into the plurality of groups, respectively, based on positions of the induction heating coils which overlap with a position of a cookware placed on the cooking plate.

18. A cooking apparatus comprising:

a cooking plate;

a plurality of induction heating coils installed under the cooking plate;

a first driver and a second driver configured to supply driving power to the plurality of induction heating coils; and a controller configured to control the first driver and the second driver to respectively drive induction heating coils belonging to a first group and a second group to which the induction heating coils among the plurality of heating coils belong, wherein a ratio of power output by the first driver and power output by the second driver is different from a ratio of a number of induction heating coils belonging to the first group and a number of induction heating coils belonging to the second group.

19. The cooking apparatus of claim 18, wherein the first group includes an induction heating coil, an entirety of which overlaps with the cookware and the second group includes an induction coil, at least portion of which is outside a position of a cookware placed on the cooking plate.

20. A method of controlling a cooking apparatus having a plurality of induction heating coils installed under a cooking plate, the method comprising:

detecting a cookware, and outputting a detection signal in response to the detection of the cookware, identifying induction heating coils among the plurality of induction heating coils based on a plurality of groups to which the plurality of induction heating coils belong, respectively;

supplying, by a plurality of drivers, driving power to the plurality of groups of the plurality of induction heating coils, respectively, based on the detection signal, wherein the supplying of the driving power includes controlling power output by a first driver, among the plurality of drivers, driving a first group among the plurality of groups to be increased, while power output by a second driver, among the plurality of drivers, driving a second group among the plurality of groups is decreased, wherein a ratio of the power output by the first driver and the power output by the second driver is different from a ratio of a number of induction heating coils belonging to the first group and a number of induction heating coils belonging to the second group.

* * * * *